US006357352B1

(12) United States Patent
Rorke et al.

(10) Patent No.: US 6,357,352 B1
(45) Date of Patent: Mar. 19, 2002

(54) LITHOGRAPHIC PRINTING PLATES FOR USE WITH LASER IMAGING APPARATUS

(75) Inventors: Thomas P. Rorke, Holyoke; Richard J. D'Amato, South Hadley, both of MA (US)

(73) Assignee: Presstek, Inc., Hudson, NH (US)

( * ) Notice: Subject to any disclaimer, the term of this patent is extended or adjusted under 35 U.S.C. 154(b) by 0 days.

(21) Appl. No.: 09/704,858

(22) Filed: Nov. 2, 2000

Related U.S. Application Data

(62) Division of application No. 09/399,905, filed on Sep. 21, 1999, now Pat. No. 6,182,570.
(60) Provisional application No. 60/101,229, filed on Sep. 21, 1998.

(51) Int. Cl.[7] ..... B41N 1/14
(52) U.S. Cl. ..... 101/457; 101/462; 101/467
(58) Field of Search ..... 101/453, 454, 101/457, 458, 459, 460, 462, 463.1, 465–467; 430/302

(56) References Cited

U.S. PATENT DOCUMENTS

| | | | | |
|---|---|---|---|---|
| 3,971,660 A | * | 7/1976 | Staehle | 101/460 |
| 4,617,250 A | | 10/1986 | Nakakita et al. | 430/175 |
| 4,853,313 A | | 8/1989 | Mori et al. | 430/156 |
| 5,093,097 A | | 3/1992 | Neifert et al. | 101/462 |
| 5,351,617 A | | 10/1994 | Williams et al. | 101/467 |
| 5,379,698 A | | 1/1995 | Nowak et al. | 101/454 |
| 5,493,971 A | | 2/1996 | Lewis et al. | 101/454 |
| 5,570,636 A | * | 11/1996 | Lewis | 101/467 |
| 5,605,780 A | | 2/1997 | Burberry et al. | 430/278.1 |
| 5,677,106 A | | 10/1997 | Burberry et al. | 430/302 |
| 5,691,063 A | | 11/1997 | Davis et al. | 101/463.1 |
| 5,908,705 A | | 6/1999 | Nguyen et al. | 101/467 |
| 5,919,600 A | | 7/1999 | Huang et al. | 430/272.1 |
| 5,985,515 A | | 11/1999 | Van Rompuy et al. | 430/272.1 |
| 6,110,645 A | | 8/2000 | DeBoer et al. | 430/302 |
| 6,186,067 B1 | * | 2/2001 | Rorke et al. | 101/467 |
| 6,192,798 B1 | * | 2/2001 | Rorke et al. | 101/467 |

* cited by examiner

*Primary Examiner*—Stephen R. Funk
(74) *Attorney, Agent, or Firm*—Testa, Hurwitz & Thibeault, LLP

(57) ABSTRACT

Provided is a lithographic printing plate comprising a support substrate having disposed thereon an ablative-absorbing layer and, optionally, a durable, ink-accepting surface layer that is not ablative-absorbing. The ablative-absorbing layer may contain a high weight per cent of an organic sulfonic acid component. The printing plate may further comprise a hydrophilic polymeric layer interposed between the ablative-absorbing layer and the substrate. The printing plate also comprises a primer layer underlying the ablative-absorbing layer with an adhesion-promoting agent, such as a zirconium compound, present in the primer layer. Also provided are methods of preparing such lithographic printing plates, and methods of preparing imaged lithographic printing plates from such lithographic printing plates by imagewise exposure to a laser and a subsequent cleaning step with water or with a cleaning solution.

15 Claims, 3 Drawing Sheets

LITHOGRAPHIC PRINTING PLATES FOR USE WITH LASER IMAGING APPARATUS

RELATED APPLICATION

This application is a divisional of U.S. Ser. No. 09/399,905 filed Sept. 21, 1999, now U.S. Pat. No. 6,182,570, which claims priority to U.S. Provisional Patent Application Ser. No. 60/101,229, titled "Lithographic Printing Plates For Use With Laser Imaging Apparatus" filed on Sept. 21, 1998.

FIELD OF THE INVENTION

The present invention relates in general to lithography and more particularly to systems for imaging lithographic printing plates using digitally controlled laser output. More specifically, this invention relates to a novel lithographic printing plate especially suitable for directly imaging and utilizing with a wet lithographic printing press.

BACKGROUND OF THE INVENTION

Traditional techniques for introducing a printed image onto a recording material include letterpress printing, gravure printing, and offset lithography. All of these printing methods require a plate. To transfer ink in the pattern of the image, the plate is usually loaded onto a plate cylinder of a rotary press for efficiency. In letterpress printing, the image pattern is represented on the plate in the form of raised areas that accept ink and transfer it onto the recording medium by impression. Gravure printing cylinders, in contrast, contain a series of wells or indentations that accept ink for deposit onto the recording medium. Excess ink must be removed from the cylinder by a doctor blade or similar device prior to contact between the cylinder and the recording medium.

The term "lithographic," as used herein, is meant to include various terms used synonymously, such as offset, offset lithographic, planographic, and others. By the term "wet lithographic," as used herein, is meant the type of lithographic printing plate where the printing is based upon the immiscibility of oil and water, wherein the oily material or ink is preferentially retained by the image area and the water or fountain solution is preferentially retained by the non-image area. When a suitably prepared surface is moistened with water and an ink is then applied, the background or non-image area retains the water and repels the ink while the image area accepts the ink and repels the water. The ink on the image area is then transferred to the surface of a material upon which the image is to be reproduced, such as paper, cloth, and the like. Commonly the ink is transferred to an intermediate material called the blanket, which in turn transfers the ink to the surface of the material upon which the image is to be reproduced. In a dry lithographic printing system that does not utilize water, the plate is simply inked and the image transferred directly onto a recording material or transferred onto a blanket and then to the recording material.

Aluminum has been used for many years as a support for lithographic printing plates. In order to prepare the aluminum for such use, it is typically subject to both a graining process and a subsequent anodizing process. The graining process serves to improve the adhesion of the image to the plate and to enhance the water-receptive characteristics of the background areas of the printing plate. The graining and anodizing affect both the performance and the durability of the printing plate. Both mechanical and electrolytic graining processes are well known and widely used in the manufacture of lithographic printing plates. Processes for anodizing aluminum to form an anodic oxide coating and then hydrophilizing the anodized surface by techniques such as silication are also well known in the art, and need not be further described herein. The aluminum support is thus characterized by having a porous, wear-resistant hydrophilic surface, which specifically adapts it for use in lithographic printing, particularly where long press runs are required.

The plates for an offset press are usually produced photographically. The aluminum substrate described above is typically coated with a wide variety of radiation-sensitive materials suitable for forming images for use in the lithographic printing process. Any radiation-sensitive layer is suitable which, after exposure and any necessary developing and/or fixing, provides an image, which can be used for printing. Lithographic printing plates of this type are usually developed with an aqueous alkaline developing solution, which often additionally comprises a substantial quantity of an organic solvent.

To prepare a wet plate using a typical negative-working substractive process, the original document is photographed to produce a photographic negative. This negative is placed on an aluminum plate having a water-receptive oxide surface coated with a photopolymer. Upon exposure to light or other radiation through the negative, the areas of the coating that received radiation (corresponding to the dark or printed areas of the original) cure to a durable oleophilic state. The plate is then subjected to a developing process that removes the uncured areas of the coating (i.e., those which did not receive radiation, corresponding to the non-image or background areas of the original), thereby exposing the hydrophilic surface of the aluminum plate.

Throughout this application, various publications, patents, and published patent applications are referred to by an identifying citation. The disclosures of the publications, patents, and published patent applications referenced in this application are hereby incorporated by reference into the present disclosure to more fully describe the state of the art to which this invention pertains.

As is evident from the above description, photographic platemaking processes tend to be time consuming and require facilities and equipment adequate to support the necessary chemistry. Efforts have been made for many years to manufacture a printing plate, which does not require development or which only uses water for development. In addition, practitioners have developed a number of electronic alternatives to plate imaging, some of which can be utilized on-press. With these systems, digitally controlled devices alter the ink-receptivity of blank plates in a pattern representative of the image to be printed. Such imaging devices include sources of electromagnetic radiation, produced by one or more laser or non-laser sources, that create chemical changes on plate blanks (thereby eliminating the need for a photographic negative); ink jet equipment that directly deposits ink-repellent or ink-accepting spots on plate blanks; and spark-discharge equipment, in which an electrode in contact with or spaced closely to a plate blank produces electrical sparks to physically alter the topology of the plate blank, thereby producing "dots" which collectively form a desired image (see, e.g., U.S. Pat. No. 4,911,075). Because of the ready availability of laser equipment and its amenability to digital control, significant effort has been devoted to the development of laser-based imaging systems. These systems include:

1) Argon-ion, frequency-doubled Nd-YAG and infrared lasers used to expose photosensitive blanks for traditional chemical processing, as for example described in U.S. Pat.

Nos. 3,506,779; 4,020,762; 4,868,092; 5,153,236; 5,372,915; and 5,629,354. In an alternative to this approach, a laser has been employed to selectively remove, in an imagewise pattern, an opaque coating that overlies a photosensitive plate blank. The plate is then exposed to a source of radiation, with the unremoved material acting as a mask that prevents radiation from reaching underlying portions of the plate, as for example described in U.S. Pat. No. 4,132,168.

However, the need for high writing speeds, coupled with the constraint of the low-powered lasers favored by industry, has resulted in a requirement for printing plates that have a very high photosensitivity. Unfortunately, high photosensitivity almost always reduces the shelf life of these plates.

2) Another approach to laser imaging uses thermal-transfer materials, as for example described in U.S. Pat. Nos. 3,945,318; 3,962,513; 3,964,389; 4,395,946; and 5,395,729. With these systems, a polymer sheet transparent to the radiation emitted by the laser is coated with a transferable material. The transfer side of this construction is brought into contact with an acceptor sheet, and the transfer material is selectively irradiated through the transparent layer. Irradiation causes the transfer material to adhere preferentially to the acceptor sheet. The transfer and acceptor materials exhibit different affinities for fountain solution and/or ink, so that removal of the transparent polymer sheet with the unirradiated transfer material still on it leaves a suitably imaged, finished plate. Typically, the transfer material is oleophilic, and the acceptor material is hydrophilic.

Plates produced with transfer type systems tend to exhibit short useful lifetimes due to the limited amount of material that can effectively be transferred. Airborne dirt can create an image quality problem depending on the particular construction. In addition, because the transfer process involves melting and resolidification of material, image quality further tends to be visibly poorer than that obtainable with other methods.

3) Other patents describe lithographic printing plates comprising a support and a hydrophilic imaging layer which, upon imagewise laser exposure, becomes oleophilic in the exposed areas while remaining hydrophilic in the unexposed areas, as for example disclosed in U.S. Pat. Nos. 3,793,033; 4,034,183; 4,081,572; and 4,693,958. However, these types of lithographic printing plates suffer from the lack of a sufficient degree of discrimination between oleophilic image areas and hydrophilic non-image areas, with the result that image quality on printing is poor.

4) Early examples utilizing lasers used the laser to etch away material from a plate blank to form an intaglio or letterpress pattern, as for example described in U.S. Pat. Nos. 3,506,779 and 4,347,785. This approach was later extended to production of lithographic plates, e.g., by removal of a hydrophilic surface to reveal an oleophilic underlayer, as for example described in U.S. Pat. No. 4,054,094. These early systems generally required high-power lasers, which are expensive and slow.

More recently, other infrared laser ablation based systems for imaging hydrophilic plates have been developed. These operate by laser-mediated removal of organic hydrophilic polymers, which are coated onto an oleophilic substrate such as a polyester/metal laminate or onto an oleophilic polymer coating on a metal support. Use of these materials between the ablation coating and the heat absorbing metal support provides a thermal barrier material which reduces the amount of laser energy required to ablate or physically transform the hydrophilic surface layer, as for example described in U.S. Pat. Nos. 5,339,737; 5,351,617; 5,353,705; 5,379,698; 5,385,092; 5,440,987; 5,487,338; 5,540,150; 5,551,341; and 5,638,753; and in Canadian Pat. No. 1,050,805. Laser output either ablates one or more plate layers, or physically transforms, the oleophobic or hydrophilic surface layer, in either case resulting in an imagewise pattern of features on the plate.

One problem with this approach is that the hydrophilic non-image areas are not sufficiently durable to permit long printing runs, and are easily scratched. Also, the hydrophilic coatings are not like the traditional hydrophilic grained and anodized surfaces and generally are considered outside the mainstream of conventional printing. One other disadvantage of these plates is that they are negative working, since the portions removed by ablation are the image regions that accept ink. When lasers with a large spot size are used for imaging, the size of the smallest printed dot is as large as the spot size. Consequently, the image quality on printing is not high. For example, a 35 micron laser spot size would print its smallest dot size at 35 microns with a negative working plate. On a 200 lines per inch (lpi) halftone screen, this is equivalent to a 5% to 6% dot.

U.S. Pat. No. 5,493,971 extends the benefit of the traditional grained metal plate to ablative laser imaging and also provides the advantage of a positive working wet lithographic plate. These plates are positive working since the portions not removed by ablation are the image regions that accept ink. This construction includes a grained metal substrate, a hydrophilic protective coating which also serves as an adhesion-promoting primer, and an ablatable oleophilic surface layer. The imaging laser interacts with the ablatable surface layer, causing an ablation thereof. When lasers with a large spot size are used for imaging, the size of the smallest printed dot can be very small since the large spot size laser beam can be programmed to remove material around a very small area. Although the smallest hole in a solid printed area is large, this does not seriously affect print quality since very small holes in solids tend to fill in with ink. Consequently, the image quality on printing is high. After imaging, the plate is then cleaned with a suitable solvent, e.g., water, revealing the hydrophilic adhesion-promoting primer or the hydrophilic metal substrate. After cleaning, the plate behaves like a conventional grained metal plate on the printing press.

However, adhesion of the remaining oleophilic surface coating to the hydrophilic protective layer has proven a difficult problem to overcome. Loss of adhesion can result in a major loss of image quality. Small dots and type are often removed during development or early in the print run. Efforts to improve the adhesion of the ablatable surface coating and/or its durability to permit longer printing runs typically leads to a significant increase in the laser energy required to image the plate.

U.S. Pat. No. 5,605,780 describes a lithographic printing plate comprising an anodized aluminum support having thereon an oleophilic image-forming layer comprising an infrared-absorbing agent dispersed in a film-forming cyanoacrylate polymer binder. The hydrophilic protective layer has been eliminated. The '780 patent describes low required laser energy, good ink receptivity, good adhesion to the support, and good wear characteristics. Print runs of more than 8,200 impressions are shown in the examples.

Despite the many efforts directed to the development of a laser imageable wet lithographic printing plate, there still remains a need for plates that require no alkaline or solvent developing solution, that look and perform like a conventional lithographic printing plate on press, that are sensitive to a broad spectrum of laser energy (700 nm to 1150 nm), that provide a high resolution image, and that will be long running on press (greater than 100,000 impressions).

SUMMARY OF THE INVENTION

One aspect of the present invention pertains to a positive working, wet lithographic printing member imageable by laser radiation comprising (a) an ink-accepting surface layer characterized by the absence of ablative absorption of the laser radiation, (b) a second layer underlying the surface layer, which second layer comprises one or more polymers and is characterized by the ablative absorption of the laser radiation, and (c) a hydrophilic substrate; wherein the second layer comprises greater than 13 weight per cent of an organic sulfonic acid component based on the total weight of polymers present in the second layer. The term "printing member," as used herein, is synonymous with the term "plate" and pertains to any type of printing member or surface capable of recording an image defined by regions exhibiting differential affinities for ink and/or fountain solution. As used herein, for the purpose of determining the weight per cent of the organic sulfonic acid component, the term "polymers" includes all the materials which are polymeric film formers, including monomeric species which polymerize or combine with a polymeric species, such as, for example, a monomeric crosslinking agent, to form the polymeric film component of the ablative-absorbing layer. In one embodiment, the organic sulfonic acid component is an aromatic sulfonic acid, preferably p-toluenesulfonic acid (PTSA). In one embodiment, the organic sulfonic acid component is a component of an amine-blocked organic sulfonic acid.

In one embodiment, the organic sulfonic acid component is present in an amount of 15 to 75 weight per cent of the total weight of polymers present in the ablative-absorbing layer of the printing member of the present invention. In another embodiment, the organic sulfonic acid component is present in an amount of 20 to 45 weight per cent of the total weight of polymers present in the ablative-absorbing layer.

In one embodiment, the thickness of the surface layer of the printing member of this invention is from about 0.1 to about 20 microns. In a preferred embodiment, the thickness of the surface layer is from about 0.1 to about 2 microns.

In one embodiment, the surface layer of the printing member of the present invention comprises a polymer and a crosslinking agent. Suitable polymers in the surface layer include, but are not limited to, polyurethanes, epoxy polymers, nitrocellulose, and polycyanoacrylates. In one embodiment, the crosslinking agent in the surface layer is a melamine. In one embodiment, the surface layer of the printing member of this invention further comprises an organic sulfonic acid component. In a preferred embodiment, the organic sulfonic acid component in the surface layer is a component of an amine-blocked p-toluenesulfonic acid.

In one embodiment, the surface layer of the printing member of this invention is further characterized by being not soluble in water or in a cleaning solution. The term "cleaning solution," as used herein, pertains to a solution used to clean or remove the residual debris from the laser-ablated region of the print member of this invention and may comprise water, solvents, and combinations thereof, including buffered water solutions, as described in U.S. Pat. 5,493,971. In a preferred embodiment, the surface layer is further characterized by being not soluble in water or in a cleaning solution and by durability on a wet lithographic printing press.

In one embodiment, the ablative-absorbing second layer of the printing member of the present invention is ink-accepting. In one embodiment, the ablative-absorbing second layer is further characterized by not accepting ink and by accepting water on a wet lithographic printing press.

In one embodiment, the thickness of the ablative-absorbing second layer of the printing member of this invention is from about 0.1 to about 20 microns. In a preferred embodiment, the thickness of the ablative-absorbing second layer is from about 0.1 to about 2 microns.

In one embodiment, the ablative-absorbing second layer of the printing member of this invention comprises an infrared sensitizer. In one embodiment, the infrared sensitizer in the ablative-absorbing second layer is a carbon black. In a preferred embodiment, the carbon black of the infrared sensitizer of the ablative-absorbing layer comprises a sulfonate group on the surface of the carbon black, and most preferably the carbon black is CAB-O-JET 200. In one embodiment, one or more polymers of the ablative-absorbing second layer of the printing member of the present invention further is a crosslinking agent. Suitable polymers in the ablative-absorbing second layer include, but are not limited to, nitrocellulose; polycyanoacrylates; polyurethanes; polyvinyl alcohols; polyvinyl acetates; polyvinyl chlorides; and copolymers and terpolymers thereof. In one embodiment, one or more of the polymers of the ablative-absorbing second layer is a hydrophilic polymer. In one embodiment, the crosslinking agent of the ablative-absorbing second layer is a melamine.

In one embodiment, the ablative-absorbing second layer of the printing member of this invention is characterized by being not soluble in water or in a cleaning solution.

Suitable substrates for this aspect of the printing member of the present invention are hydrophilic and include, but are not limited to, metals, papers, and polymeric films.

Suitable polymeric films for the substrate include, but are not limited to, polyesters, polycarbonates, and polystyrene. In one embodiment, the polymeric film of the substrate is treated to make it hydrophilic. In one embodiment, the substrate is a polyester film, preferably a polyethylene terephthalate film. Suitable metals for the substrate include, but are not limited to, aluminum, copper, chromium, and steel. In a preferred embodiment, the metal of the substrate is grained, anodized, silicated, or a combination thereof. In a preferred embodiment, the substrate is aluminum.

Another aspect of the present invention pertains to a positive working, wet lithographic printing member imageable by laser radiation comprising (a) an ink-accepting surface layer characterized by the absence of ablative absorption of the laser radiation, as described herein; (b) a second layer under the surface layer, which second layer comprises one or more polymers and is characterized by the ablative absorption of the laser radiation, as described herein; (c) a hydrophilic third layer underlying the second layer, which third layer is characterized by the absence of ablative absorption of the laser radiation; and (d) a substrate; wherein the second layer comprises greater than 13 weight per cent of an organic sulfonic acid component, as described herein, based in the total weight of polymers present in the second layer. In one embodiment, the thickness of the third layer of the printing member of this invention is from about 1 to about 40 microns. In one embodiment, the thickness of the third layer is from about 2 to about 25 microns.

In one embodiment, the hydrophilic third layer of the printing member of the present invention comprises a hydrophilic polymer and a crosslinking agent. Suitable hydrophilic resins for the third layer include, but are not limited to, polyvinyl alcohols and cellulosics. In a preferred embodiment, the hydrophilic polymer of the third layer is polyvinyl alcohol. In one embodiment, the crosslinking agent is a zirconium compound such as, for example, ammonium zirconyl carbonate.

In one embodiment, the hydrophilic third layer of the printing member of this invention is characterized by being not soluble in water or in a cleaning solution. In one embodiment, the hydrophilic third layer is characterized by being not excessively soluble in water or in a cleaning solution.

Suitable substrates for this aspect of the printing member of the present invention, which printing member comprises a hydrophilic polymeric or third layer interposed between the ablative-absorbing layer and the substrate, are either hydrophilic or non-hydrophilic/ink-accepting and include, but are not limited to, metals, papers, and polymeric films. Suitable polymeric films for the substrate include, but are not limited to, polyesters, polycarbonates, and polystyrene. In one embodiment, the polymeric film of the substrate is treated to make it hydrophilic. In one embodiment, the substrate is a polyester film, preferably a polyethylene terephthalate film. Suitable metals for the substrate include, but are not limited to, aluminum, copper, chromium, and steel. In a preferred embodiment, the metal of the substrate is grained, anodized, silicated, or a combination thereof. In a preferred embodiment, the substrate is aluminum.

One aspect of the present invention pertains to a positive working, wet lithographic printing member imageable by laser radiation comprising (a) an ink-accepting surface layer characterized by the absence of ablative absorption of the laser radiation, as described herein; (b) a second layer underlying the surface layer, which second layer comprises one or more polymers and is characterized by the ablative absorption of the laser radiation, as described herein; and (c) a hydrophilic substrate, as described herein; wherein interposed between the second layer and the hydrophilic substrate is a primer layer comprising an adhesion-promoting agent. The primer layer is characterized by the absence of ablative absorption of the laser radiation. In one embodiment, the primer layer is characterized by being hydrophilic, by the absence of ablative absorption of the laser radiation, by being not ablated by the ablative absorption of the second or ablative-absorbing layer, and by being not soluble in water. In one embodiment, the primer layer is further characterized by being not removed by the ablative absorption of the second layer followed by a cleaning step with water or a cleaning solution to remove any residue of the ablative absorption of the second layer from the surface of the primer layer.

In one embodiment, the adhesion-promoting agent of the primer layer comprises a zirconium compound. In one embodiment, the adhesion-promoting agent of the primer layer comprises ammonium zirconyl carbonate. In one embodiment, the adhesion-promoting agent of the primer layer comprises zirconium propionate. In one embodiment, the adhesion-promoting agent of the primer layer comprises zirconium oxide. In one embodiment, the primer layer is an inorganic gel layer, preferably an inorganic gel layer comprising a zirconium oxide gel.

In another embodiment, the adhesion-promoting agent of the primer layer comprises an organic sulfonic acid component, preferably an aromatic sulfonic acid, and more preferably p-toluenesulfonic acid. In one embodiment, the organic sulfonic acid component in the primer layer interposed between the ablative-absorbing second layer and the hydrophilic substrate is present in an amount of 2 to 100 weight per cent of the primer layer, preferably in an amount of 50 to 100 weight per cent of the primer layer, and most preferably in an amount of 80 to 100 weight per cent of the primer layer.

In one embodiment, the thickness of the primer layer interposed between the second layer and the substrate is from about 0.01 to about 2 microns, and preferably from about 0.01 to about 0.1 microns.

Another aspect of the present invention pertains to a positive working, wet lithographic printing member imageable by laser radiation comprising (a) an ink-accepting surface layer characterized by the absence of ablative absorption of the laser radiation, as described herein; (b) a second layer underlying the surface layer, which second layer comprises one or more polymers and is characterized by the ablative absorption of the laser radiation, as described herein; (c) a hydrophilic third layer underlying the second layer, which third layer is characterized by the absence of ablative absorption of the laser radiation, as described herein; and (d) a substrate, as described herein; wherein interposed between the second and the third layer is a primer layer comprising an adhesion-promoting agent. The primer layer is characterized by the absence of ablative absorption of the laser radiation. In one embodiment, the primer layer is characterized by being hydrophilic, by the absence of ablative absorbtion of the laser radiation, by being not ablated by the ablative absorption of the second or ablative-absorbing layer, and by being not soluble in water. In one embodiment, the primer layer is further characterized by being not removed by the ablative absorption of the second layer followed by a cleaning solution to remove any residue of the ablative absorption of the second layer from the surface of the primer layer.

In one embodiment, the adhesion-promoting agent of the primer layer comprises a zirconium compound. In one embodiment, the adhesion-promoting agent of the primer layer comprises ammonium zirconyl carbonate. In one embodiment, the adhesion-promoting agent of the primer layer comprises zirconium propionate. In one embodiment, the adhesion-promoting agent of the primer layer comprises zirconium oxide. In one embodiment, the primer layer is an inorganic gel layer, preferably an inorganic gel layer comprising a zirconium oxide gel. In another embodiment, the adhesion-promoting agent of the primer layer comprises an organic sulfonic acid component, preferably an aromatic sulfonic acid. In one embodiment, the organic sulfonic acid component in the primer layer interposed between the second and the third layer is present in an amount of 2 to 100 weight per cent of the primer layer, preferably in an amount of 50 to 100 weight per cent of the primer layer, and most preferably in an amount of 80 to 100 weight per cent of the primer layer.

In one embodiment, the thickness of the primer layer interposed between the second and the third layer is from about 0.01 to about 2 microns, and preferably from about 0.01 to about 0.1 microns.

Another aspect of the present invention pertains to methods of preparing a positive working, wet lithographic printing member imageable by laser radiation, as described herein.

In a preferred embodiment, the method of preparing a positive working, wet lithographic printing member imageable by laser radiation comprises (a) providing a grained and anodized metal substrate, (b) coating a hydrophilic polymer layer on the substrate, which polymer layer comprises a hydrophilic polymer and a crosslinking agent and subsequently curing the polymer layer, (c) coating an intermediate layer over the polymer layer, which intermediate layer comprises an ablative-absorbing sensitizer, a hydrophilic polymer, and a crosslinking agent, and subsequently curing the intermediate layer to form an ablative-absorbing layer, and (d) coating an ink-accepting surface layer over the intermediate layer, which surface layer comprises a polymer and a crosslinking agent, and subsequently curing to form a thin durable ink-accepting surface layer; wherein the intermediate layer further comprises greater than 13 weight per cent of an organic sulfonic acid component based on the total weight of polymers present in the second layer. In a more preferred embodiment, the surface layer of the printing member further comprises an organic sulfonic acid component.

Yet another aspect of this invention pertains to methods of preparing an imaged wet lithographic printing plate comprising (a) providing a positive working, wet lithographic printing member, as described herein; (b) exposing the printing member to a desired imagewise exposure of laser radiation to ablate part of the ink-accepting surface layer of the printing member and to ablate a part of the ablative-absorbing second layer of the printing member to form a residual composite layer on the hydrophilic substrate or, alternatively, on the hydrophilic third layer if one is present; and (c) cleaning the residual composite layer from the hydrophilic substrate or, alternatively, from the hydrophilic third layer if one is present underlying the ablative-absorbing second layer of the printing member, which cleaning is done with water or with a cleaning solution; wherein the ink-accepting surface layer of the printing member is not soluble in water or in the cleaning solution.

The lithographic printing members of this invention are positive working plates. The second layer, which is ablative absorptive, and the surface layer, which is ink-accepting, oleophilic, hydrophobic, and durable, are ablated and substantially completely removed in a post-imaging cleaning step in the regions exposed to the laser radiation so that the non-exposed regions serve as the ink-transferring surface in lithographic printing. After imaging, in a preferred embodiment, when a hydrophilic third layer is present underlying the ablative-absorbing second layer, a crosslinked hydrophilic polymeric third layer remains on the plate in the laser imaged areas, along with a quantity of ablation by-products or residual composite layer, typically loosely bound to the hydrophilic third layer. The hydrophilic third layer enhances the clean-up of the by-product or residual composite layer, since it is much easier to remove from the hydrophilic third layer than from a hydrophilic substrate, such as a grained and anodized aluminum surface. One advantage of the present invention is that the lithographic printing member or plate can be used to print immediately, since fountain solution will easily clean the ablation debris or residual composite layer from the plate. In the course of a long printing run, the hydrophilic third layer, when present, typically is not solubilized, and non-hydrophilic substrates may be utilized. Optionally, the hydrophilic third layer may only very slowly solubilize, and hydrophilic substrates are then preferred so that, if the hydrophilic third layer is removed by solubilization, the hydrophilic substrate is uncovered underneath. In this latter case, the printing characteristics of the non-image areas are not affected since one hydrophilic layer is merely exchanged for another. On the other hand, the hydrophilic third layer under the non-exposed image areas of the present invention provides an excellent adhesion primer for this image layer since it is nearly impossible to undercut through solubilization, particularly when the hydrophilic third layer is crosslinked.

The superiority of the lithographic printing member of the present invention over those previously known is particularly manifest in its ability to be imaged rapidly with relatively inexpensive diode lasers with large spot sizes, its ease of cleaning, its excellent image resolution and printing quality, its resistance to water, alkali, and solvents which provides excellent durability and image adhesion on the printing press, and its low cost of manufacture.

The presence of greater than 13 weight per cent of an organic sulfonic acid component based on the total polymers present in the ablative-absorbing second layer and, optionally, the presence of an organic sulfonic acid component in the ink-accepting surface layer, in the hydrophilic third layer when present, and in a primer layer when present, significantly enhances the combination of high laser sensitivity, high image resolution, ease of cleaning the residual composite layer formed in the laser-exposed areas, and the excellent durability, adhesion, and water and fountain solution resistance of the ink-accepting image areas on the printing press that are desired in lithographic printing utilizing direct imaging by lasers.

Yet another aspect of the present invention pertains to a positive working, wet lithographic printing member comprising an ablative-absorbing layer as an ink-accepting surface layer, wherein the ablative-absorbing layer comprises greater than 13 weight per cent of an organic sulfonic acid component, as described herein, based on the total weight of polymers present in the ablative-absorbing layer. The high weight per cent of an organic sulfonic acid component in the ablative-absorbing surface layer provides the lithographic printing member with the combined benefits of rapid imaging, ease of cleaning the residual non-ablated debris in the laser imaged areas, excellent image resolution and quality, and resistance to water for excellent durability and image adhesion on the printing press, but without requiring the additional non-ablative absorbing, ink-accepting overcoat surface layer of other aspects of this invention. Thus, another aspect of the present invention pertains to a positive working, wet lithographic printing member imageable by laser radiation comprising (a) an ink-accepting surface layer, which surface layer comprises one or more polymers and is characterized by the ablative absorption of laser radiation, as described herein; (b) optionally, a hydrophilic polymeric layer, which hydrophilic polymeric layer underlies the surface layer and is characterized by the absence of ablative absorption of the laser radiation, as described herein; and, (c) a substrate, as described herein; wherein the surface layer further comprises greater than 13 weight per cent of an organic sulfonic acid component based on the total weight of polymers present in the surface layer.

Further, still another aspect of the present invention pertains to a positive working, wet lithographic printing member imageable by laser radiation comprising (a) an ink-accepting surface layer, which surface layer comprises one or more polymers and is characterized by the ablative absorption of the laser radiation, as described herein; (b) optionally, a hydrophilic polymeric layer, which hydrophilic polymeric layer underlies the surface layer and is characterized by the absence of ablative absorption of the laser radiation, as described herein; and, (c) a substrate, as described herein; wherein interposed between the hydrophilic polymeric layer and the surface layer is a primer layer comprising an adhesion-promoting agent. The primer layer is characterized by the absence of ablative absorption of the laser radiation. In one embodiment, the primer layer is characterized by being hydrophilic, by the absence of ablative absorption of the laser radiation, by being not ablated by the ablative absorption of the surface or ablative-absorbing layer, and by being not soluble in water. In one embodiment, the primer layer is further characterized by being not removed by the ablative absorption of the surface layer followed by a cleaning step with water or a cleaning solution to remove any residue of the ablative absorption of the surface layer from the surface of the primer layer. In one embodiment, the adhesion-promoting agent of the primer layer comprises a zirconium compound. In one embodiment, the adhesion-promoting agent of the primer layer comprises ammonium zirconyl carbonate. In one embodiment, the adhesion-promoting agent of the primer layer comprises zirconium propionate. In one embodiment, the adhesion-promoting agent of the primer layer comprises zirconium oxide. In one embodiment, the primer layer is an inorganic gel layer, preferably an inorganic gel layer comprising a zirconium oxide gel. In another embodiment, the adhesion-promoting agent of the primer layer comprises an organic sulfonic acid component, preferably an aromatic sulfonic acid. In one embodiment, the organic sulfonic acid component in the primer layer interposed between the hydrophilic polymeric layer and the ablative-absorbing surface layer is present in the amount of 2 to 100 weight per cent of the primer layer, preferably in an amount of 50 to 100 weight per cent of the primer layer, and most preferably in an amount of 80 to 100 weight per cent of the primer layer. In one embodiment, in addition to the presence of the primer layer, the ablative-absorbing surface layer further comprises greater than 13 weight per cent of an organic sulfonic acid component based on the total weight of polymers present in the ablative-absorbing surface layer.

Yet another aspect of this invention pertains to methods of preparing an imaged wet lithographic printing member comprising (a) providing a positive working, wet lithographic printing member comprising an ink-accepting surface layer, which surface layer comprises one or more polymers and is characterized by the ablative absorption of laser radiation, as described herein, (b) exposing the printing member to a desired imagewise exposure of laser radiation to ablate part of the ablative-absorbing surface layer of the printing member to form a residual composite layer on the hydrophilic substrate or, alternatively, on the hydrophilic polymeric second layer if one is present, and (c) cleaning the residual composite layer from the hydrophilic substrate or, alternatively, from the hydrophilic polymeric second layer if one is present underlying the surface layer of the printing member, which cleaning is done with water or with a cleaning solution; wherein the ablative-absorbing, ink-accepting surface layer of the printing member is not soluble in water or in the cleaning solution.

As one of skill in the art will appreciate, features of one embodiment and aspect of the invention are applicable to other embodiments and aspects of the invention.

The above-discussed and other features and advantages of the present invention will be appreciated and understood by those skilled in the art from the following detailed description and drawings.

BRIEF DESCRIPTION OF THE DRAWINGS

The foregoing discussion will be understood more readily from the following detailed description of the invention when taken in conjunction with the accompanying drawings.

DETAILED DESCRIPTION OF THE INVENTION

Organic Sulfonic Acids

Figure 1A:
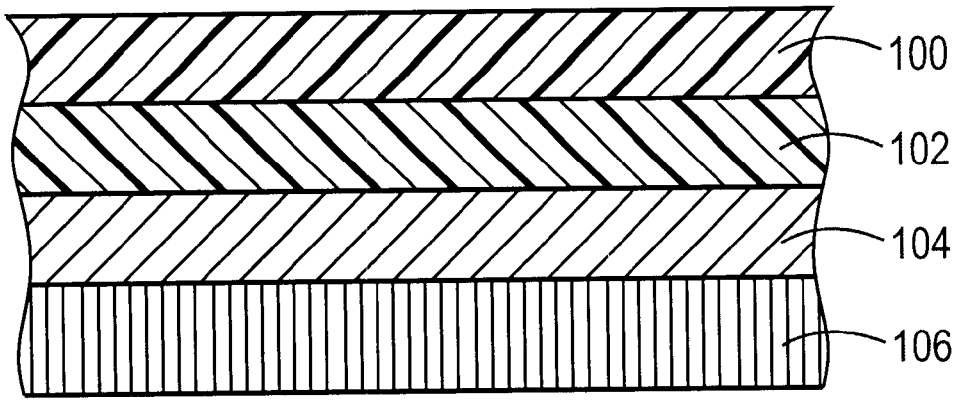
FIG. 1A shows an enlarged cross-sectional view of a lithographic plate of the present invention having an ink-accepting surface layer, an ablative-absorbing second layer, a hydrophilic third layer, and a support substrate.
Figure 1B:
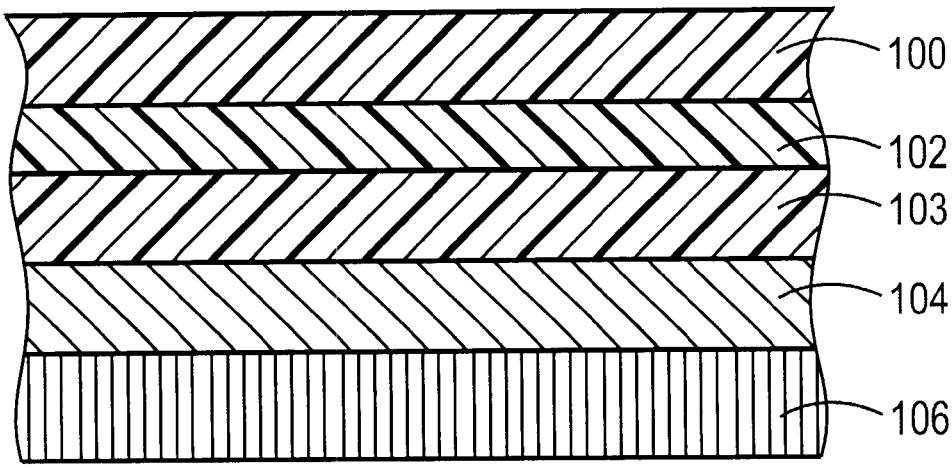
FIG. 1B shows an enlarged cross-sectional view of a lithographic plate of the present invention having an ink-accepting surface layer, an ablative-absorbing second layer, a primer layer, a hydrophilic third layer, and a support substrate.

One aspect of the present invention pertains to the use of organic sulfonic acids in a positive working, wet lithographic printing member imageable by laser radiation, particularly the use of large amounts of an organic sulfonic acid component in the ablative-absorbing layer of the printing member.

For example, as described in present applicants' U.S. Provisional Pat. Application, Ser. No. 60/072,358 titled "Lithographic Printing Plates for Use with Laser Discharge Imaging Apparatus," filed on Jan. 23, 1998, about 5.4 weight per cent of p-toluenesulfonic acid (PTSA) component in NACURE 2530, a trademark for an amine-blocked organic sulfonic acid catalyst available from King Industries, Norwalk, Conn., based on the total weight of polymers present was utilized in the ablative-absorbing second layer. This PTSA-based catalyst assisted in the curing of the CYMEL 303, a trademark for melamine crosslinking agents available from Cytec Corporation, Wayne, N.J., AIRVOL 125, a trademark for polyvinyl alcohol polymers available from Air Products, Allentown, Pa., and UCAR WBV-110, a trademark for a vinyl copolymer water-based dispersion available from Union Carbide Corporation, Danbury, Conn., polymers that constitute the polymeric film-forming materials in the ablative-absorbing second layer. To calculate the weight per cent of organic sulfonic acid component in the ablative-absorbing layer of the present invention, the weight of organic sulfonic acid component (p-toluenesulfonic acid constitutes 25 per cent by weight of NACURE 2530 in the examples in the above-mentioned provisional patent application and in the examples of the present invention) is divided by the total dry weight of polymers present (in this example, the combined weight of CYMEL 303, AIRVOL 125, and UCAR WBV-110). In this example, the weight of p-toluenesulfonic acid is the weight of NACURE 2530 (1.2 parts by weight) multiplied by 0.25 to give 0.3 parts by weight of p-toluenesulfonic acid. The combined weight of polymers is calculated by adding the parts by dry weight of AIRVOL 125 (2.20 parts by weight), UCAR WBV-110 (2.10 parts by weight), and CYMEL 303 (1.21 parts by weight) for a total of 5.51 parts by weight. Dividing the weight of the p-toluenesulfonic acid (0.3 parts by weight) by this combined total of polymers present (5.51 parts by weight) and multiplying by 100 to convert to per cent by weight gives 5.4 weight per cent for the weight per cent of the organic sulfonic acid component in the ablative-absorbing layer for this example.

Surprisingly, it has been found that significantly increased levels of an organic sulfonic acid component, such as the p-toluenesulfonic acid in NACURE 2530, in the ablative-absorbing layer to weight per cents greater than 13% of the total weight of polymers present provide significant improvements in the ease of cleaning the laser-exposed areas, in the durability and adhesion of the ink-accepting areas of the plate during long press runs, in the sensitivity to the laser radiation, and in the fine image resolution and printing quality that can be achieved. These weight per cents of greater than 13 weight per cent of the total weight of polymers present are higher than the levels of organic sulfonic acid catalysts typically utilized to accelerate the curing of coatings. These benefits from high levels of organic sulfonic acid components may be obtained without any significant disadvantages, such as loss in resistance to solubilization by water, by the fountain solution, or by a cleaning solution.

In addition to the benefits of increased levels of an organic sulfonic acid component in the ablative-absorbing second layer of the lithographic printing member, the concomitant presence of an organic sulfonic acid component in the ink-accepting surface layer of the printing member may provide further increased benefits.

In one embodiment, the organic sulfonic acid component is present in a primer layer between the ablative-absorbing second layer and either the hydrophilic third layer or, alternatively, between the ablative-absorbing second layer and a hydrophilic substrate when no hydrophilic third layer is present in the product construction. The levels of organic sulfonic acid component in the primer layer may vary widely and include, but are not limited to, the range of 2 to 100 weight per cent of the primer layer. The benefits of the organic sulfonic acid component in the primer layer of the present invention are similar to those achieved with the increased levels of an organic sulfonic acid component in the ablative-absorbing layer.

The term "organic sulfonic acid," as used herein, refers to organic compounds that have at least one sulfonic acid moiety, —$SO_3H$, covalently bonded to a carbon atom of the organic compound. The term "organic sulfonic acid component," as used herein, pertains to free organic sulfonic acids and also pertains to the free organic sulfonic acids formed when a blocked or latent organic sulfonic acid catalyst, is decomposed, such as by heat or by radiation, to form a free or unblocked organic sulfonic acid to catalyze the desired curing reaction, as is well known in the art. The weight of the free organic sulfonic acid that may be obtained from the blocked or latent organic sulfonic acid catalyst is used herein to calculate the weight per cent of the organic sulfonic acid component based on the total weight of polymers present in the ablative-absorbing coating layer. As is well known in the art, the blocked organic sulfonic acid catalysts may be an adduct or complex of an organic sulfonic acid with a complexing material, such as an amine, and the molar ratios of the organic sulfonic acid and the complexing material may vary widely, such as, for example, from 1.0:0.5 to 1.0:2.0. Alternatively, the blocked organic sulfonic acid catalysts may be a reaction product of an organic sulfonic acid with a suitable material, such as, for example, with an alcohol to provide the blocked catalyst in the form of an ester of an organic sulfonic acid. A wide variety of blocked or latent organic sulfonic acid catalysts are known and may be utilized in the present invention to provide the organic sulfonic acid component. Examples of suitable blocked or latent organic sulfonic acid catalysts that provide suitable organic sulfonic acid components include, but are not limited to, amine-blocked organic sulfonic acids such as, for example, described in U.S. Pat. Nos. 4,075,176; 4,200,729; 4,632,964; 4,728,545; 4,812,506; 5,093,425; 5,187,019; 5,681,890; and 5,691,002; esters of an organic sulfonic acid as, for example, described in U.S. Pat. Nos. 4,192,826; 4,323,660; 4,331,582; 4,618,564; 5,102,961; 5,364,734; and 5,716,756; reaction products of an organic sulfonic acid and a glycidamide as, for example, described in U.S. Pat. No. 4,839,427; and amides of an organic sulfonic acid as, for example, described in U.S. Pat. No. 4,618,526. Instead of the free or unblocked organic sulfonic acid in the coating solutions to be applied to a substrate, the blocked or latent organic sulfonic acid catalysts are typically utilized to crosslink coatings in order to provide a stable shelf life to the coating solution by reducing the viscosity buildup due to premature crosslinking and because of the better coating uniformity and water resistance often obtained in the finished coating layers.

A wide variety of organic sulfonic acid components are known and may be utilized in the present invention. Examples of suitable organic sulfonic acid components include, but are not limited to, organic sulfonic acids having a $pK_a$ below 4, such as, for example, p-toluenesulfonic acid, dodecylbenzenesulfonic acid, dinonylnaphthalene sulfonic acid, tridecylbenzene sulfonic acid, methane sulfonic acid, polystyrene sulfonic acid, and dodecylbenzenedisulfonic acid. In one embodiment, the organic sulfonic acid component of the present invention is an aromatic sulfonic acid. In a preferred embodiment, the organic sulfonic acid component is p-toluenesulfonic acid (PTSA).

In one embodiment, the organic sulfonic acid component of the present invention is a component of a blocked or latent organic sulfonic acid catalyst, preferably an amine-blocked organic sulfonic acid. The term "amine," as used herein, pertains to ammonia, as well as to aliphatic primary, secondary, and tertiary amines, including heterocyclic amines having a saturated ring. In one embodiment, the amine-blocked organic sulfonic acid is an amine-blocked aromatic sulfonic acid. In a preferred embodiment, the amine-blocked organic sulfonic acid is an amine-blocked p-toluenesulfonic acid, such as, for example, NACURE 2530.

The amounts of organic sulfonic acid components typically used to catalyze polymer curing in coating layers is in the range of 0.1 to 12 weight per cent based on the total weight of polymers present, exclusive of pigments. Preferred amounts are typically less than 5 weight per cent with about 1 weight per cent or less being particularly preferred. For example, U.S. Pat. No. 4,728,545 discloses a preferred range for the amine-blocked organic sulfonic acid catalyst of from 0.01 to 3.0% by weight of the total solid content of the coating composition exclusive of pigments. Since the organic sulfonic acid component is less than 100% of the weight of the amine-blocked catalyst, the preferred range for the organic sulfonic acid component in the '545 patent is even below 0.01 to 3.0% by weight. The '545 patent describes greater than 3.0% by weight of amine-blocked organic sulfonic acid catalyst as adversely affecting the appearance, strength, and other properties of the resulting film when the organic sulfonic acid component remains therein at high concentrations.

Lithographic Printing Members with Hydrophilic Third Layers

Referring now to FIG. 1A, which illustrates a preferred embodiment of a lithographic printing member in accordance with the present invention, the printing member comprises an ink-accepting and durable surface layer 100, an ablative-absorbing second layer 102, a hydrophilic third layer 104, and a support substrate 106. Each of these layers is discussed in more detail below.

Ink-Accepting Surface Layers

The primary characteristics of ink-accepting surface layer 100 are its oleophilicity and hydrophobicity, resistance to solubilization by water and solvents, and durability on the printing press. Suitable polymers utilized in this layer should have relatively low decomposition temperatures to assist in the heat-induced ablative imaging initiated in the ablative-absorbing second layer 102, excellent adhesion to the ablative-absorbing second layer 102, and high wear resistance. They can be either water-based or solvent-based polymers. Ink-accepting surface layer 100 should also, upon imaging, produce environmentally and toxicologically innocuous decomposition by-products. This layer also may include a crosslinking agent which provides improved bonding to the ablative-absorbing second layer 102 and increased durability of the plate for extremely long print runs.

Suitable polymers include, but are not limited to, polyurethanes, nitrocellulose, polycyanoacrylates, and epoxy polymers. For example, polyurethane based materials are typically extremely tough and may have thermosetting or self-curing capability. An exemplary coating layer may be prepared by mixing and coating methods known in the art, for example, wherein a mixture of polyurethane polymer and hexamethoxymethylmelamine crosslinking agent in a suitable solvent, water, or solvent-water blend is combined, followed by the addition of a suitable amine-blocked p-toluenesulfonic acid catalyst to form the finished coating mix. The coating mix is then applied to the ablative-absorbing second layer 102 using one of the conventional methods of coating application, such as wire wound rod coating, reverse roll coating, gravure coating, and slot die coating, and subsequently dried to remove the volatile liquids and to form a coating layer.

Polymeric systems containing components in addition to polyurethane polymers may also be combined to form the ink-accepting surface layer 100. For example, an epoxy polymer may be added to a polyurethane polymer in the presence of a crosslinking agent and a catalyst.

Ink-accepting surface layer 100 is coated in this invention typically at a thickness in the range of from about 0.1 microns to about 20 microns and more preferably in the range of from about 0.1 to about 2 microns. After coating, the layer is dried and preferably cured at a temperature of between 145° C. and 165° C.

Ablative-Absorbing Second Layers

The primary characteristics of ablative-absorbing second layer 102 are vulnerability or sensitivity to ablation using commercially practicable laser imaging equipment, and sufficient adhesion to the hydrophilic third layer 104 and the ink-accepting surface layer 100 to provide long running plates and retention of small 2% and 3% dots in halftone images while running on press. It is also preferable that the ablative-absorbing second layer 102 produces environmentally and toxicologically innocuous decomposition by-products upon ablation. Vulnerability to laser ablation ordinarily arises from strong absorption in the wavelength region in which the imaging laser emits. It is also advantageous to use polymers having relatively low decomposition temperatures to assist in the heat-induced ablative imaging. Adhesion to the hydrophilic third layer 104 is dependent in part upon the chemical structure and the amount of the material that absorbs the laser radiation and the bonding sites available on the polymers in the ablative-absorbing second layer 102. It is important that the bonding by the polymers in the ablative-absorbing second layer 102 is strong enough to provide adequate adhesion to the hydrophilic third layer 104, but is easily weakened during laser ablation and subsequently provides ease of cleaning of the residual debris layer in the ablated areas from the hydrophilic third layer 104. For example, vinyl-type polymers, such as polyvinyl alcohol, strike an appropriate balance between these two properties. Alternatively, nitrocellulose by itself or in combination with vinyl-type polymers provides a high degree of vulnerability to ablation. Suitable coatings may be formed by incorporating a solvent dispersible carbon black into the coating. For example, a base coating mix is formed by admixture of all components, such as 6 sec. RS Nitrocellulose available from Aqualon Co., Wilmington, Del.; VULCAN XC 72R, a trademark for carbon black pigments available from Cabot Corporation, Bedford, Mass.; CYMEL 303 hexamethoxymethylmelamine crosslinking agent; and a crosslinking catalyst which is subsequently added to the base coating mix just prior to the coating application operation. For example, improved adhesion to the hydrophilic third layer 104 as well as easy cleaning after imaging is provided by use of AIRVOL 125 polyvinyl alcohol incorporated into the ablative-absorbing second layer 102. Crosslinking agents may also be added.

A radiation-absorbing compound or sensitizer is added to the composition of the ablative-absorbing second layer 102 and dispersed therein. When the laser radiation is of an infrared wavelength, a variety of infrared-absorbing compounds are known and may be utilized as the radiation-absorbing sensitizer in the present invention. Of the infrared sensitizers evaluated, CAB-O-JET 200, a trademark for surface modified carbon black pigments available from Cabot Corporation, Bedford, Mass., surprisingly least affected the adhesion to the hydrophilic third layer 104 at the amounts required to give adequate sensitivity for ablation. In other words, CAB-O-JET 200 has good ablative-sensitizing properties, and also allows enhanced adhesion to the hydrophilic third coating layer 104.

The results obtained with CAB-O-JET 200 were better than those obtained with a related compound, CAB-O-JET 300. The CAB-O-JET series of carbon black products are unique aqueous pigment dispersions made with novel surface modification technology, as, for example, described in U.S. Pat. Nos. 5,554,739 and 5,713,988. Pigment stability is achieved through ionic stabilization. The surface of CAB-O-JET 300 has carboxyl groups, while that of CAB-O-JET 200 contains sulfonate groups. No surfactants, dispersion aids, or polymers are typically present in the dispersion of the CAB-O-JET materials. CAB-O-JET 200 is a black liquid, having a viscosity of less than about 10 cP (Shell #2 efflux cup); a pH of about 7; 20% (based on pigment) solids in water; a stability (i.e., no change in any physical property) of more than 3 freeze-thaw cycles at −20° C., greater than six weeks at 70° C., and more than 2 years at room temperature; and a mean particle size of 0.12 microns, with 100% of the particles being less than 0.5 microns. Significantly, CAB-O-JET 200 also absorbs across the entire infrared spectrum. Suitable coatings may be formed by known mixing and coating methods, for example, wherein a base coating mix is formed by first mixing all the components, such as water; 2-butoxyethanol; AIRVOL 125 polyvinyl alcohol; UCAR WBV-110 vinyl copolymer; CYMEL 303 hexamethoxymethylmelamine crosslinking agent; and CAB-O-JET 200 carbon black, except for not including any crosslinking catalyst. To extend the stability of the coating formulation, any crosslinking agent, such as NACURE 2530, is subsequently added to the base coating mix or dispersion just prior to the coating application. The coating mix or dispersion may be applied by any of the known methods of coating application, such as, for example, wire wound rod coating, reverse roll coating, gravure coating, and slot die coating. After drying to remove the volatile liquids, a solid coating layer is formed.

The ablative-absorbing second layer 102 comprises one or more polymers. In one embodiment, the ablative-absorbing layer 102 comprises a crosslinking agent. Suitable polymers include, but are not limited to, nitrocellulose; polycyanocrylates; polyurethanes; polyvinyl alcohols; polyvinyl acetates; polyvinyl chlorides; and copolymers and terpolymers thereof. In one embodiment, one or more polymers of the ablative-absorbing second layer 102 is a hydrophilic polymer. In one embodiment, the crosslinking agent of the ablative-absorbing second layer 102 is a melamine.

A particular aspect of the present invention is the presence of an organic sulfonic acid catalyst in the ablative-absorbing second layer 102 at levels higher than those typically used for catalyst purposes, such as, for example, 0.01 to 12 weight per cent based on the total weight of polymers present in the coating layer for conventional crosslinked coatings.

For example, in the aforementioned U.S. Pat. No. 5,493,971, NACURE 2530 is present in Examples 1 to 8 as a catalyst for the thermoset-cure of an ablative-absorbing surface layer. By assuming that the NACURE 2530 used in these examples in the '971 patent contained the same 25% by weight of p-toluenesulfonic acid as reported by the manufacturer for the lots of NACURE 2530 used in the examples of the present invention, calculation of the weight per cent of the p-toluenesulfonic acid component in the ablative-absorbing surface layer of the '971 patent may be done by multiplying the weight of NACURE 2530 (4 parts by weight) by 0.25 to give 1.0 parts by weight and then dividing the 1.0 parts by weight by the combined dry weight of the polymers present (13.8 parts by weight in Examples 1 to 7 and 14.0 parts by weight in Example 8) to give 7.2 weight per cent (Examples 1 to 7 of the '971 patent) and 7.1 weight per cent (Example 8 of the '971 patent).

In one aspect of the present invention, the ablative-absorbing second layer 102 comprises greater than 13 weight per cent of an organic sulfonic acid component based on the total weight of polymers present in the ablative absorbing second layer. In one embodiment, the organic sulfonic acid component is an aromatic sulfonic acid. In a preferred embodiment, the organic sulfonic acid component is p-toluenesulfonic acid, such as, for example, present as a component of the amine-blocked p-toluenesulfonic acid, NACURE 2530.

In one embodiment, the organic sulfonic acid component is present in an amount of 15 to 75 weight per cent of the total weight of polymers present in the ablative-absorbing second layer 102. In a preferred embodiment, the organic sulfonic acid component is present in an amount of 20 to 45 weight per cent of the total weight of polymers present in the ablative-absorbing second layer 102.

Ablative-absorbing second layer 102 is typically coated at a thickness in the range of from about 0.1 to about 20 microns and more preferably in the range of from about 0.1 to about 2 microns. After coating, the layer is dried and subsequently cured at a temperature between 135° C. and 185° C. for between 10 seconds and 3 minutes and more preferably cured at a temperature between 145° C. and 165° C. for between 30 seconds to 2 minutes.

In one embodiment, the ablative-absorbing second layer 102 of the printing member of the present invention is ink-accepting. Examples of an ink-accepting, ablative-absorbing second layer are illustrated in Examples 1 and 6 of the present invention.

In another embodiment, the ablative-absorbing second layer 102 is further characterized by not accepting ink and by accepting water on a wet lithographic printing press, as illustrated in Example 5 of this invention.

In one embodiment, the ablative-absorbing second layer 102 of the printing member of the present invention is characterized by being not soluble in water or in a cleaning solution.

Hydrophilic Third Layers

Hydrophilic third layer 104 provides a thermal barrier during laser exposure to prevent heat loss and possible damage to the substrate 106, when the substrate is a metal, such as aluminum. It is hydrophilic so that it may function as the background hydrophilic or water-loving area on the imaged wet lithographic plate. It should adhere well to the support substrate 106 and to the ablative-absorbing second layer 102. In general, polymeric materials satisfying these criteria include those having exposed polar moieties such as hydroxyl or carboxyl groups such as, for example, various cellulosics modified to incorporate such groups, and polyvinyl alcohol polymers.

Preferably, the hydrophilic third layer 104 withstands repeated application of fountain solution during printing without substantial degradation or solubilization. In particular, degradation of the hydrophilic third layer 104 may take the form of swelling of the layer and/or loss of adhesion to both the ablative-absorbing second layer 102 and/or to the substrate 106. This swelling and/or loss of adhesion may deteriorate the printing quality and dramatically shorten the press life of the lithographic plate. One test of withstanding the repeated application of fountain solution during printing is a wet rub resistance test, as described in Examples 1 to 6 of this invention. Satisfactory results for withstanding the repeated application of fountain solution and not being excessively soluble in water or in a cleaning solution, as defined herein for the present invention, are the retention of the 3% dots in the wet rub resistance test, as described and illustrated in Examples 1 to 6 of this invention.

To provide insolubility to water, for example, polymeric reaction products of polyvinyl alcohol and crosslinking agents such as glyoxal, zinc carbonate, and the like are well known in the art. For example, the polymeric reaction products of polyvinyl alcohol and hydrolyzed tetramethylorthosilicate or tetraethylorthosilicate are described in U.S. Pat. No. 3,971,660. Suitable polyvinyl alcohol-based coatings may be obtained by mixing and coating methods known in the art by combining, for example, AIRVOL 125 polyvinyl alcohol; BACOTE 20, a trademark for an ammonium zirconyl carbonate solution available from Magnesium Elektron, Flemington, N.J.; glycerol, available from Aldrich Chemical, Milwaukee, Wis.; and TRITON X-100, a trademark for a surfactant available from Rohm & Haas, Philadelphia, Pa.

In one embodiment, the hydrophilic third layer 104 of the printing member of the present invention comprises a hydrophilic polymer and a crosslinking agent. Suitable hydrophilic polymers for the hydrophilic third layer 104 include, but are not limited to, polyvinyl alcohol and cellulosics. In a preferred embodiment, the hydrophilic polymer of the third layer is polyvinyl alcohol. In one embodiment, the crosslinking agent is a zirconium compound, preferably ammonium zirconyl carbonate.

In one embodiment, the hydrophilic third layer 104 is characterized by being not soluble in water or in a cleaning solution. In another embodiment, the hydrophilic third layer 104 is characterized by being not excessively soluble in water or in a cleaning solution.

Hydrophilic third layer 104 is coated in this invention typically at a thickness in the range of from about 1 to about 40 microns and more preferably in the range of from about 2 to about 25 microns. After coating, the layer is dried and subsequently cured at a temperature between 135° C. and 185° C. for between 10 seconds and 3 minutes and more preferably at a temperature between 145° C. and 165° C. for between 30 seconds and 2 minutes.

Substrates

Suitable substrates for support substrate 106 may be a number of different substrates, including those known in the art as substrates for lithographic printing plates, such as, for example, metals, papers, and polymeric films. Since the hydrophilic third layer 104 is typically not soluble in water, in a cleaning solution, or in the fountain solution, and further is not ablated during the imaging, the substrate does not need to be hydrophilic to provide the discrimination between the ink-accepting or non-hydrophilic image areas of the surface layer and the water-accepting or hydrophilic background areas of the plate needed for wet lithographic printing. The term, "hydrophilic," as used herein, pertains to the property of a material or a composition of materials that allows it to preferentially retain water or a water-based fountain solution in wet lithographic printing while the non-hydrophilic, ink-accepting materials or composition of materials on the surface ofthe plate preferentially retain the oily material or ink. Thus, the substrate 106 either may be hydrophilic or may be non-hydrophilic/ink-accepting when a hydrophilic polymeric layer such as layer 104 is interposed between the ablative-absorbing layer and the substrate.

Suitable metals include, but are not limited to, aluminum, copper, steel, and chromium, preferably that have been rendered hydrophilic through graining or other treatments. The printing members of this invention preferably use an anodized aluminum support substrate. Examples of such supports include, but are not limited to, aluminum which has been anodized without prior graining, aluminum which has been grained and anodized, and aluminum which has been grained, anodized, and treated with an agent effective to render the substrate hydrophilic, for example, treatment to form a silicate layer. It is preferred in this invention to use aluminum which has been grained, anodized, and treated with a hydrophilic material.

A wide variety of papers may be utilized. Typically, these papers have been treated or saturated with a polymeric treatment to improve dimensional stability, water resistance, and strength during the wet lithographic printing. Examples of suitable polymeric films include, but are not limited to, polyesters such as polyethylene terephthalate and polyethylene naphthalate, polycarbonates, polystyrene, polysulfones, and cellulose acetate. A preferred polymeric film is polyethylene terphthalate film, such as, for example, the polyester films available under the trademarks of MYLAR and MELINEX polyester films from E. I. duPont de Nemours Co., Wilmington, Del. Where the polymeric film substrate is not hydrophilic, these supports may further comprise a hydrophilic surface formed on at least one surface of the support such as, for example, a hydrophilic coating layer comprising a hydrophilic material applied to the polymeric film, such as, for example, to polyethylene terephthalate film or to other polymeric films that are not intrinsically hydrophilic or that may benefit from a special hydrophilic surface added to the substrate. Preferred thicknesses for support substrate 106 range from 0.003 to 0.02 inches, with thicknesses in the range of 0.005 to 0.015 inches being particularly preferred.

Lithographic Printing Plates With Hydrophilic Third Layers and Primer Layers

Referring to FIG. 1A, another aspect of the present invention and its utilization of organic sulfonic acids to enhance the laser imaging sensitivity, printing quality, cleanability, press durability, ink-accepting image adhesion, and fine dot resolution of lithographic printing plates is the incorporation of a primer layer 103 interposed between the ablative-absorbing second layer 102 and the hydrophilic third layer 104, wherein the primer layer 103 comprises an adhesion-promoting agent, in which the primer layer is characterized by the absence of ablative absorption of the laser radiation. Suitable adhesion-promoting agents include, but are not limited to, organic sulfonic acid components, zirconium compounds, titanates, and silanes. In one embodiment, the organic sulfonic acid component of the adhesion-promoting agent in the primer layer is an aromatic sulfonic acid. In a preferred embodiment, the organic sulfonic acid component of the adhesion-promoting agent in the primer layer is p-toluenesulfonic acid.

In one embodiment, the organic sulfonic acid component in the primer layer interposed between the ablative-absorbing second layer 102 and the hydrophilic third layer 104 is present in an amount of 2 to 100 weight per cent of the primer layer, preferably in an amount of 50 to 100 weight per cent of the primer layer, and most preferably in an amount of 80 to 100 weight per cent of the primer layer.

In one embodiment, the thickness of the primer layer interposed between the ablative-absorbing second layer 102 and the hydrophilic third layer 104 is from about 0.01 to about 2 microns, and preferably from about 0.01 to about 0.1 microns.

When this primer layer comprising an organic sulfonic acid component is present, the increased levels of an organic sulfonic acid component in the ablative-absorbing second layer 102 of the present invention may not be necessary to provide the multiple benefits desired, and the level of an organic sulfonic acid component in the ablative-absorbing second layer 102 may be less than 13 weight per cent of the total weight of the polymers present in the ablative-absorbing second layer or may even be negligible. However, it is suitable to use a combination of the primer layer and the ablative-absorbing second layer 102 comprising greater than 13 weight per cent of an organic sulfonic acid component of the present invention.

In one embodiment, the adhesion-promoting agent of the primer layer is ammonium zirconyl carbonate such as, for example, BACOTE 20. BACOTE 20 is a zirconia sol from Magnesium Elektron, Inc., with a weight equivalent of 21% zirconium oxide, which has been modified by the addition of 10% zirconium nitrate hydrate. The cured residue of an applied BACOTE 20 solution is reported to be water-insoluble and to have excellent adhesion to chrome substrates and photopolymer coatings in photopolymer coated lithographic printing plates and may also have hydrophilic properties depending on the overlying coating, as described in U.S. Pat. Nos. 4,522,912 and 4,581,285. In another embodiment, the adhesion-promoting agent of the primer layer is zirconium propionate. Other suitable zirconium compounds in the primer layer of the present invention include, but are not limited to, those zirconium-based adhesion promoters described in "The Use of Zirconium in Surface Coatings," Application Information, Sheet 117 (Provisional), by P. J. Moles, Magnesium Elektron, Inc., Flemington, N.J. In one embodiment, the primer layer is characterized by being hydrophilic, by the absence of ablative absorption of the laser radiation, by being not ablated by the ablative absorption of the second or ablative-absorbing layer, and by being not soluble in water. In one embodiment, the primer layer is further characterized by being not removed by the ablative absorption of the second layer followed by a cleaning step with water or a cleaning solution to remove any residue of the ablative absorption of the second layer from the surface of the primer layer. In one embodiment, the adhesion-promoting agent of the primer layer comprises zirconium oxide. In one embodiment, the primer layer is an inorganic gel layer, preferably an inorganic gel layer comprising a zirconium oxide gel.

Lithographic Printing Plates Without Hydrophilic Third Layers

Figure 3:
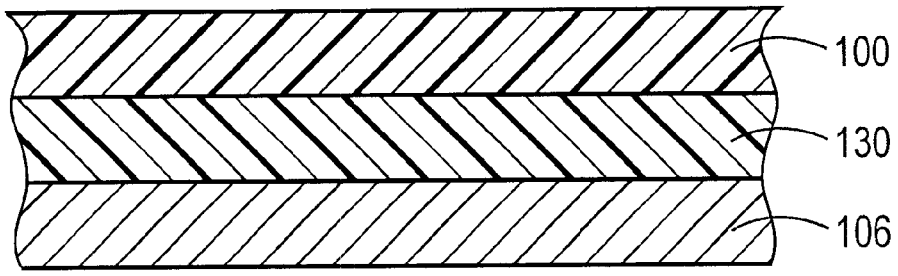
FIG. 3 shows an enlarged cross-sectional view of an alternative embodiment of a lithographic plate in accordance with the present invention having an ink-accepting surface layer, an ablative-absorbing second layer, and a hydrophilic support substrate.

An alternative embodiment of a positive working wet lithographic plate is shown in FIG. 3, comprising a support substrate 106, an ablative-absorbing layer 130, and an ink-accepting surface layer 100. The support substrate 106 is hydrophilic. An example of a support layer and ablative-absorbing layer having this configuration, but without an additional ink-accepting surface layer present, is given in the above-referenced U.S. Pat. No. 5,605,780.

One aspect of the lithographic printing members of the present invention, that do not comprise a hydrophilic third layer, comprises an ink-accepting surface layer, an ablative-absorbing second layer, and a hydrophilic support substrate. The ink-accepting surface layer and the ablative-absorbing second layer are as described herein for the lithographic printing members of the present invention that do comprise a hydrophilic third layer overlying the support substrate. The support substrate 106, as shown in FIG. 3, is as described for only those support substrates that are hydrophilic, as described for the lithographic printing members of the present invention that do comprise a hydrophilic third layer overlying the support substrate.

In particular, the lithographic printing members of the present invention, that do not comprise a hydrophilic third layer overlying the support substrate, share the key aspect of this invention in the presence of large amounts of an organic sulfonic acid component in one or more layers of the printing member. For example, in one aspect of the present invention, the lithographic printing members, that do not comprise a hydrophilic third layer overlying the support substrate, comprise an organic sulfonic acid component present in the ablative-absorbing layer 130 at levels higher than those typically used for catalyst purposes, such as, for example, 0.01 to 12 weight per cent based on the total weight of polymers present in the coating layer for conventional crosslinked coatings. Thus, one aspect of the present invention pertains to a positive working, wet lithographic printing member imageable by laser radiation comprising (a) an ink-accepting surface layer characterized by the absence of ablative absorption of the laser radiation, (b) a second layer underlying the surface layer, which second layer comprises one or more polymers and is characterized by the ablative absorption of the laser radiation, and (c) a hydrophilic substrate, wherein the second layer comprises greater than 13 weight per cent of an organic sulfonic acid component based on the total weight of polymers present in the second layer. In one embodiment, the organic sulfonic acid component is an aromatic sulfonic acid. In a preferred embodiment, the organic sulfonic acid component is p-toluenesulfonic acid, such as, for example, present as a component of the amine-blocked p-toluenesulfonic acid, NACURE 2530.

In one embodiment, the organic sulfonic acid component is present in an amount of 15 to 75 weight per cent of the total weight of polymers present in the ablative-absorbing second layer 130. In a preferred embodiment, the organic sulfonic acid component is present in an amount of 20 to 45 weight per cent of the total weight of polymers present in the ablative-absorbing second layer 130.

Except for the absence of a hydrophilic third layer underlying the ablative-absorbing second layer 130 and overlying the support substrate 106 as described for the lithographic printing members of the present invention that comprise hydrophilic third layers, the other aspects of the coating layers of the lithographic printing member without a hydrophilic third layer, including such aspects as the ink-accepting surface layer and the ablative-absorbing second layer, are as described herein for the lithographic printing members with hydrophilic third layers.

Referring to FIG. 3, still another aspect of the present invention and its utilization of organic sulfonic acids to enhance the laser imaging sensitivity, printing quality, cleanability, press durability, ink-accepting image adhesion, and fine dot resolution of lithographic printing plates is the incorporation of a primer layer interposed between the ablative-absorbing second layer 130 and the hydrophilic support substrate 106, wherein the primer layer comprises an adhesion-promoting agent, in which the primer layer is characterized by the absence of ablative absorption of the laser radiation. Suitable adhesion-promoting agents include, but are not limited to, organic sulfonic acid components, zirconium compounds, titanates, and silanes. In one embodiment, the organic sulfonic acid component of the adhesion-promoting agent in the primer layer is an aromatic sulfonic acid. In a preferred embodiment, the organic sulfonic acid component of the adhesion-promoting agent in the primer layer is p-toluenesulfonic acid.

In one embodiment, the organic sulfonic acid component in the primer layer interposed between the ablative-absorbing second layer 130 and the hydrophilic support substrate 106, as shown in FIG. 3, is present in an amount of 2 to 100 weight per cent of the primer layer, preferably in an amount of 50 to 100 weight per cent of the primer layer, and most preferably in an amount of 80 to 100 weight per cent of the primer layer.

In one embodiment, the thickness of the primer layer interposed between the ablative-absorbing second layer 130 and the hydrophilic support substrate 106 is from about 0.01 to about 2 microns, and preferably from about 0.01 to about 0.1 microns.

When this primer layer comprising an organic sulfonic acid component is present, the increased levels of an organic sulfonic acid in the ablative-absorbing second layer 130 of the present invention may not be necessary to provide the multiple benefits desired, and the level of an organic sulfonic acid component in the ablative-absorbing second layer 130 may be less than 13 weight per cent of the total weight of polymers present in the ablative-absorbing second layer or may even be negligible. However, it is suitable to utilize a combination of the primer layer and the ablative-absorbing second layer 130 comprising greater than 13 weight per cent of an organic sulfonic acid component of the present invention.

In one embodiment, the zirconium compound of the adhesion-promoting agent of the primer layer is ammonium zirconyl carbonate such as, for example, BACOTE 20. In another embodiment, the zirconium compound of the adhesion-promoting agent of the primer layer is zirconium propionate. Other suitable zirconium compounds in the primer layer of the present invention include, but are not limited to, those zirconium-based adhesion promoters described in "The Use of Zirconium in Surface Coatings," Application Information, Sheet 117 (Provisional), by P. J. Moles, Magnesium Elektron, Inc., Flemington, N.J. In one embodiment, the primer layer is characterized by being hydrophilic, by the absence of ablative absorption of the laser radiation, by being not ablated by the ablative absorption of the second or ablative-absorbing layer, and by being not soluble in water. In one embodiment, the primer layer is further characterized by being not removed by the ablative absorption of the second layer followed by a cleaning step with water or a cleaning solution to remove any residue of the ablative absorption of the second layer from the surface of the primer layer. In one embodiment, the adhesion-promoting agent of the primer layer comprises zirconium oxide. In one embodiment, the primer layer is an inorganic gel layer, preferably an inorganic gel layer comprising a zirconium oxide gel.

Figure 4:
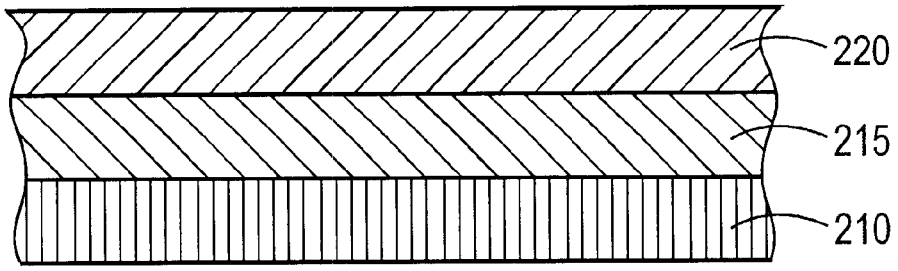
FIG. 4 shows an enlarged cross-sectional view of an alternative embodiment of a lithographic plate of this invention having an ablative-absorbing, ink-accepting surface layer, a hydrophilic polymeric second layer, and a support substrate.

Lithographic Printing Plates With Hydrophilic Second Layers and With Ablative-Absorbing Surface Layers An alternative embodiment of a positive working wet lithographic plate is shown in FIG. 4, comprising a support substrate 210, a hydrophilic polymeric layer 215, and an ablative-absorbing, ink-accepting surface layer 220. An example of a support layer, an intermediate polymeric layer, and an ablative-absorbing, ink-accepting layer having this configuration is given in the above-referenced U.S. Pat. No. 5,493,971.

One aspect of the lithographic printing members of the present invention, that do not comprise a non-ablative absorbing surface layer, comprises an ablative-absorbing, ink-accepting surface layer; a hydrophilic polymeric layer; and a support substrate. The support substrate 210 of this aspect of the invention is as described herein for the support substrate 106 of the lithographic printing members with hydrophilic third layers, as illustrated in FIG. 1A. Similarly, the hydrophilic polymeric layer 215 of this aspect of the invention is as described herein for the hydrophilic third layer 104 of the lithographic printing members with hydrophilic third layers, as illustrated in FIG. 1A. The ablative-absorbing, ink-accepting surface layer 220 of this aspect of the present invention is as described herein for the ablative-absorbing second layer 102 of the lithographic printing members with hydrophilic third layers, as illustrated in FIG. 1A, except that there is no non-ablative absorbing, ink-accepting surface layer 100 overlying the ablative-absorbing layer 220.

In particular, the lithographic printing members of the present invention, that do not comprise a non-ablative absorbing surface layer overlying the ablative-absorbing layer, share the key aspect of this invention in the presence of significant amounts of an organic sulfonic acid component in one or more layers of the printing member. For example, in one aspect of the present invention, the lithographic printing member, as illustrated in FIG. 4, comprises an organic sulfonic acid component present in the ablative-absorbing layer 220 at levels higher than those typically used for catalyst purposes, such as, for example, 0.01 to 12 weight per cent based on the total weight of polymers present in the coating layer for conventional crosslinked coatings. Thus, one aspect of the present invention pertains to a positive working, wet lithographic printing member imageable by laser radiation comprising (a) an ink-accepting surface layer, which surface layer comprises one or more polymers and is characterized by the ablative absorption of the laser radiation, (b) a hydrophilic polymeric layer underlying said surface layer, and (c) a substrate, wherein the surface layer comprises greater than 13 weight per cent of an organic sulfonic acid component based on the total weight of polymers present in the surface layer. In one embodiment, the organic sulfonic acid component is an aromatic sulfonic acid. In a preferred embodiment, the organic sulfonic acid component is p-toluenesulfonic acid, such as, for example, present as a component of the amine-blocked p-toluenesulfonic acid, NACURE 2530.

In one embodiment, the organic sulfonic acid is present in an amount of 15 to 75 weight per cent of the total weight of polymers present in the ablative-absorbing surface layer 220. In a preferred embodiment, the organic sulfonic acid component is present in an amount of 20 to 45 weight per cent of the total weight of polymers present in the ablative-absorbing surface layer 220.

Referring to FIG. 4, still another aspect of the present invention and its utilization of organic sulfonic acids to enhance the laser imaging sensitivity, printing quality, cleanability, press durability, ink-accepting image adhesion, and fine dot resolution of wet lithographic printing plates is the incorporation of a primer layer interposed between the ablative-absorbing surface layer 220 and the hydrophilic polymeric layer 215, wherein the primer layer comprises an adhesion-promoting agent, in which the primer layer is characterized by the absence of ablative absorption of the laser radiation. Suitable adhesion-promoting agents include, but are not limited to, organic sulfonic acid components, zirconium compounds, titanates, and silanes. In one embodiment, the adhesion-promoting agent in the primer layer is an organic sulfonic acid component, preferably an aromatic sulfonic acid, and, more preferably, p-toluenesulfonic acid.

In one embodiment, the organic sulfonic acid component in the primer layer interposed between the ablative-absorbing surface layer 220 and the hydrophilic polymeric layer 215 is present in an amount of 2 to 100 weight per cent of the primer layer, preferably in an amount of 50 to 100 weight per cent of the primer layer, and most preferably in an amount of 80 to 100 weight per cent of the primer layer.

In one embodiment, the thickness of the primer layer interposed between the ablative-absorbing surface layer 220 and the hydrophilic polymeric layer 215 is from about 0.01 to about 2 microns, and preferably from about 0.01 to about 0.1 microns.

When this primer layer comprising an organic sulfonic acid component is present, the increased levels of an organic sulfonic acid in the ablative-absorbing surface layer 220 of the present invention may not be necessary to provide the multiple benefits desired, and the level of an organic sulfonic acid component in the ablative-absorbing surface layer 220 may be less than 13 weight per cent of the total weight of polymers present in the ablative-absorbing surface layer or may even be negligible. However, it is suitable to utilize a combination of the primer layer and the ablative-absorbing surface layer 220 comprising the greater than 13 weight per cent of an organic sulfonic acid component of the present invention.

In one embodiment, the adhesion-promoting agent of the primer layer is ammonium zirconyl carbonate such as, for example, BACOTE 20. In another embodiment, the adhesion-promoting agent of the primer layer is zirconium propionate. Other suitable zirconium compounds in the primer layer of the present invention include, but are not limited to, those zirconium-based adhesion promoters described in "The Use of Zirconium in Surface Coatings," Application Information, Sheet 117 (Provisional), by P. J. Moles, Magnesium Elektron, Inc., Flemington, N.J. In one embodiment, the primer layer is characterized by being hydrophilic, by the absence of ablative absorption of the laser radiation, by being not ablated by the ablative absorption of the ablative-absorbing layer, and by being not soluble in water. In one embodiment, the primer layer is further characterized by being not removed by the ablative absorption of the ablative absorbing layer followed by a cleaning step with water or a cleaning solution to remove any residue of the ablative absorption of the ablative absorbing layer from the surface of the primer layer. In one embodiment, the adhesion-promoting agent of the primer layer comprises zirconium oxide. In one embodiment, the primer layer is an inorganic gel layer, preferably an inorganic gel layer comprising zirconium oxide gel.

Figure 5:
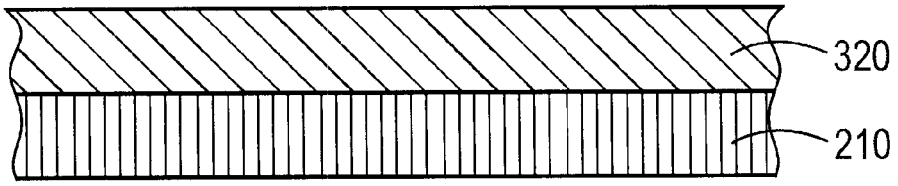
FIG. 5 shows an enlarged cross-sectional view of an alternative embodiment of a lithographic plate of the present invention having an ablative-absorbing, ink-accepting surface layer and a hydrophilic support substrate.

Lithographic Printing Plates Without Hydrophilic Third Layers and With Ablative-Absorbing Surface Layers An alternative embodiment of a positive working, wet lithographic plate is shown in FIG. 5, comprising a hydrophilic support substrate 210 and an ablative-absorbing, ink-accepting surface layer 320. An example of a support layer and ablative-absorbing surface layer having this configuration is given in the above-referenced U.S. Pat. No. 5,605,780.

The lithographic printing members of the present invention, that do not comprise a hydrophilic third layer and further do not comprise a non-ablative absorbing, ink-accepting surface layer, comprise an ablative-absorbing, ink-accepting surface layer and a hydrophilic support substrate. The hydrophilic support substrate 210 of this aspect of the invention is as described herein for the hydrophilic support substrate 106 of the lithographic printing members without hydrophilic third layers, as illustrated in FIG. 3. The ablative-absorbing, ink-accepting layer 320 of this aspect of the present invention is as described herein for the ablative-absorbing second layer 130 of the lithographic printing members without hydrophilic third layers, as illustrated in FIG. 3, except that there is not an non-ablation absorbing, ink-accepting surface layer 100 overlying the ablative-absorbing layer.

In particular, the lithographic printing members of the present invention, that do not comprise a hydrophilic third layer overlying the support substrate and further do not comprise a non-ablative absorbing surface layer, share the key aspect of this invention in the presence of large amounts of an organic sulfonic acid component in one or more layers of the printing member. For example, in one aspect of this invention, the lithographic printing member, as illustrated in FIG. 5, comprises an organic sulfonic acid component present in the ablative-absorbing layer 320 at a level higher than that typically used for catalyst purposes, such as, for example, 0.01 to 12 weight per cent based on the total weight of polymers present in the coating layer for conventional crosslinked coatings. Thus, one aspect of the present invention pertains to a positive working, wet lithographic printing member imageable by laser radiation comprising (a) an ink-accepting surface layer, which surface layer comprises one or more polymers and is characterized by the ablative absorption of the laser radiation, and (b) a hydrophilic substrate; wherein the surface layer comprises greater than 13 weight per cent of an organic sulfonic acid component based on the total weight of polymers present in the surface layer. In one embodiment, the organic sulfonic acid component is an aromatic sulfonic acid. In a preferred embodiment, the organic sulfonic acid component is p-toluenesulfonic acid, such as, for example, present as a component of the amine-blocked p-toluenesulfonic acid, NACURE 2530.

In one embodiment, the organic sulfonic acid component is present in an amount of 15 to 75 weight per cent of the total weight of polymers present in the ablative-absorbing surface layer 320. In a preferred embodiment, the organic sulfonic acid component is present in an amount of 20 to 45 weight per cent of the total weight of polymers present in the ablative-absorbing surface layer 320.

Referring to FIG. 5, still another aspect of the present invention and its utilization of organic sulfonic acids to enhance the laser imaging sensitivity, printing quality, cleanability, press durability, ink-accepting image adhesion, and fine dot resolution of wet lithographic printing plates is the incorporation of a primer layer interposed between the ablative-absorbing surface layer 320 and the support substrate 210, wherein the primer layer comprises an adhesion-promoting agent, in which the primer layer is characterized by the absence of ablative absorption of the laser radiation. Suitable adhesion-promoting agents include, but are not limited to, organic sulfonic acid components, zirconium compounds, titanates, and silanes. In one embodiment, the adhesion-promoting agent in the primer layer is an organic sulfonic acid component, preferably an aromatic sulfonic acid, and, more preferably, p-toluenesulfonic acid.

In one embodiment, the organic sulfonic acid component in the primer layer interposed between the ablative-absorbing surface layer 320 and the hydrophilic support substrate 210 is present in an amount of 2 to 100 weight per cent of the primer layer, preferably in an amount of 50 to 100 weight per cent of the primer layer, and most preferably in an amount of 80 to 100 weight per cent of the primer layer.

In one embodiment, the thickness of the primer layer interposed between the ablative-absorbing surface layer 320 and the hydrophilic support substrate 210 is from about 0.01 to about 2 microns, and preferably from about 0.01 to about 0.1 microns.

When this primer layer comprising an organic sulfonic acid component is present, the increased levels of an organic sulfonic acid component in the ablative-absorbing surface layer 320 of the present invention may not be necessary to provide the multiple benefits desired, and the level of an organic sulfonic acid component in the ablative-absorbing surface layer 320 may be less than 13 weight per cent of the total weight of polymers present in the ablative-absorbing surface layer or may even be negligible. However, it is preferred to utilize a combination of the primer layer and the ablative-absorbing surface layer 320 comprising the greater than 13 weight per cent of an organic sulfonic acid component of the present invention.

In one embodiment, the adhesion-promoting agent of the primer layer is ammonium zirconyl carbonate such as, for example, BACOTE 20. In another embodiment, the adhesion-promoting agent of the primer layer is zirconium propionate. Other suitable zirconium compounds in the primer layer of the present invention include, but are not limited to, those zirconium-based adhesion promoters described in "The Use of Zirconium in Surface Coatings," Application Information, Sheet 117 (Provisional), by P. J. Moles, Magnesium Elektron, Inc., Flemington, N.J. In one embodiment, the primer layer is characterized by being hydrophilic, by the absence of ablative absorption of the laser radiation, by being not ablated by the ablative absorption of the second or ablative-absorbing layer, and by being not soluble in water. In one embodiment, the primer layer is further characterized by being not removed by the ablative absorption of the second layer followed by a cleaning step with water or a cleaning solution to remove any residue of the ablative absorption of the second layer from the surface of the primer layer. In one embodiment, the adhesion-promoting agent of the primer layer comprises zirconium oxide. In one embodiment, the primer layer is an inorganic gel layer, preferably an inorganic gel layer comprising a zirconium oxide gel.

Imaging Apparatus

Imaging apparatus suitable for use in conjunction with the present invention include, but are not limited to, known laser imaging devices such as infrared laser devices that emit in the infrared spectrum. Laser outputs can be provided directly to the plate surface via lenses or other beam-guiding components, or transmitted to the surface of a printing plate from a remotely sited laser using a fiber-optic cable. The imaging apparatus can operate on its own, functioning solely as a platemaker, or it can be incorporated directly into a lithographic printing press. In the latter case, printing may commence immediately after application of the image to a blank plate. The imaging apparatus can be configured as a flatbed recorder or as a drum recorder.

The laser-induced ablation of the wet lithographic printing plates of the present invention may be carried out using a wide variety of laser imaging systems known in the art of laser-induced ablation imaging, including, but not limited to, the use of continuous and pulsed laser sources, and the use of laser radiation of various ultraviolet, visible, and infrared wavelengths. Preferably, the laser-induced ablation of this invention is carried out utilizing a continuous laser source of near-infrared radiation, such as, for example, with a diode laser emitting at 830 nm.

Imaging Techniques

In operation, the plates of the present invention are imaged in accordance with methods well-known to those of ordinary skill in the art. Thus, a lithographic printing plate of the present invention is selectively exposed, in a pattern representing an image, to the output of an imaging laser which is scanned over the plate. Referring to FIG. 1A, radiative laser output removes and/or damages or transforms the ablative-absorbing second layer 102 and the ink-accepting surface layer 100, thereby directly producing on the plate an array of image features or potential image features.

Figure 2A:
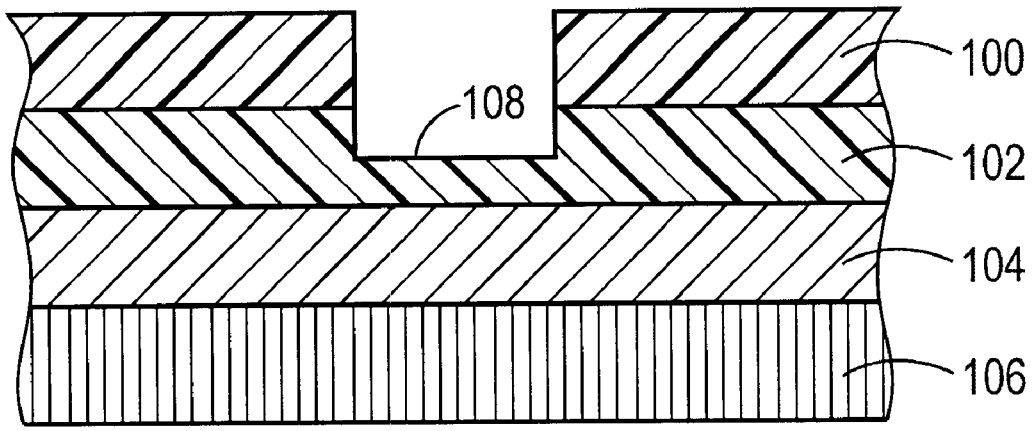
FIGS. 2A and 2B show enlarged cross-sectional views of the lithographic plate of FIG 1A: (A) after imaging; and (B) after cleaning.
Figure 2B:
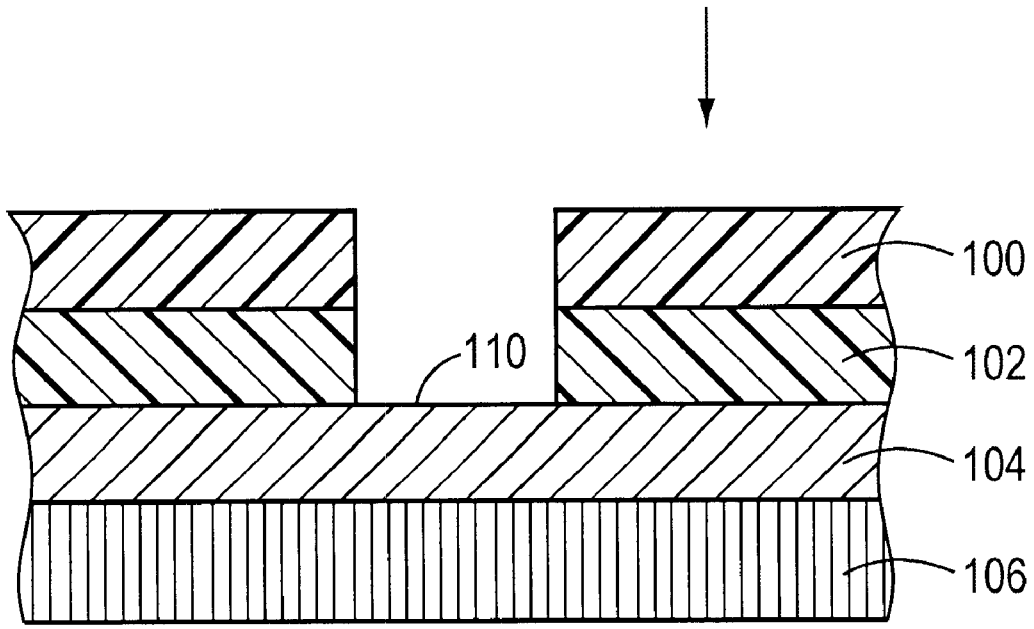

FIGS. 2A and 2B show this imaging process in greater detail. As shown in FIG. 2A, imaging radiation partially removes layers 100 and 102, leaving residual debris 108 on the hydrophilic third layer 104. The laser-imaged plate is then cleaned with water or fountain solution in order to remove debris 108, thereby exposing the surface 110 of the hydrophilic third layer 104 as shown in FIG. 2B. Alternatively, when a primer layer which is characterized by being hydrophilic, by the absence of ablative absorption of the laser radiation, by being not ablated by the ablative absorption of the ablative-absorbing layer, and by being not soluble in water, is present, the primer layer is the surface 110 on which the residual debris is in contact and which is exposed by the cleaning step, since the primer layer is not removed by the cleaning step. When the plate is imaged and placed on the press without water cleaning, debris 108 is carried by the conveying rollers back to the bulk source of fountain solution.

Thus, in one aspect of the present invention, a method of preparing an imaged wet lithographic printing plate comprises (a) providing a wet lithographic printing member of the present invention; (b) exposing the printing member to a desired imagewise exposure of laser radiation to ablate a part of the ink-accepting surface layer and a part of the ablative-absorbing second layer to form a residual debris or residual composite layer on the hydrophilic third or hydrophilic polymeric layer, or alternatively, to form a residual composite layer on the hydrophilic substrate when no hydrophilic third or hydrophilic polymeric layer is present underlying the ablative-absorbing second layer and overlying the substrate; and (c) cleaning the residual composite layer from the hydrophilic third layer with water or with a cleaning solution, or alternatively, from the hydrophilic substrate when no such hydrophilic third or hydrophilic polymeric layer is present; wherein the ink-accepting surface layer of the printing member is not soluble in water or in the cleaning solution. In one embodiment, in step (b), the residual debris is formed on the primer layer, and in step (c), cleaning of the residual composite layer is done with water or a cleaning solution from the primer layer.

EXAMPLES

Several embodiments of the present invention are described in the following examples, which are offered by way of description and not by way of limitation.

Example 1

Lithographic printing plates in accordance with the invention were prepared using a brush grained, electrochemically etched, and anodized aluminum sheet with a silicate overlayer. The aluminum sheet was coated with a hydrophilic polymeric layer, as illustrated by layer 104 in FIG. 1A. The following components shown on a dry weight basis for the solids were mixed in water to make a 6.3% by weight solution:

| Component | Parts |
|---|---|
| AIRVOL 125 | 6.25 |
| BACOTE 20 | 2.50 |
| Glycerol | 0.25 |
| TRITON X-100 | 0.10 |

A #18 wire wound rod was used to apply the hydrophilic polymeric coating formulation to the aluminum sheet. After curing this hydrophilic layer containing AIRVOL 125, BACOTE 20, glycerol, and TRITON X-100 for 120 seconds at 145° C., the following ablative-absorbing second layers were coated using a #4 wire wound rod on the cured hydrophilic polymeric layer and cured for 120 seconds at 145° C. to provide samples with three different ablative-absorbing second layers: A, B, and C. The ablative-absorbing second layer was cured for 120 seconds at 145° C.

| Component | Parts (A) | Parts (B) | Parts (C) |
|---|---|---|---|
| AIRVOL 125 (5% solids in water) | 44.0 | 44.0 | 44.0 |
| UCAR WBV-110 (48% solids in water) | 4.37 | 4.37 | 4.37 |
| 2-Butoxyethanol | 3.75 | 3.75 | 3.75 |
| CYMEL 303 | 1.21 | 1.21 | 1.21 |
| CAB-O-JET 200 (20% solids in water) | 14.5 | 14.5 | 14.5 |
| TRITON X-100 (10% solids in water) | 3.60 | 3.60 | 3.60 |
| NACURE 2530 (25% PTSA) | 1.20 | 6.0 | 10.8 |
| Water | 27.37 | 22.57 | 17.77 |

An ink-accepting first layer from a water-based formulation was then overcoated using a #3 wire wound rod upon each of the second layers: A, B, and C. Each was then cured for 120 seconds at 145° C. The coating formulation was as follows:

| Component | Parts |
|---|---|
| WITCOBOND W-240 (30% solids in water) | 11.4 |
| 2-Butoxyethanol | 1.0 |
| CYMEL 303 | 1.2 |
| NACURE 2530 (25% PTSA) | 2.4 |
| TRITON X-100 (10% solids in water) | 1.0 |
| Water | 83 |

WITCOBOND W-240 is a trademark for aqueous polyurethane dispersions available from Witco Corp., Chicago, IL.

Plates with each of the different second layers (A, B, and C), were imaged on a PEARLSETTER 74, a trademark for laser imaging equipment available from Presstek, Inc., Hudson, N.H., containing IR laser diodes emitting energy at 870 nm. The laser spot size was 35 microns. The laser energy at the plate surface was approximately 700 mj/cm$^2$. Plates were cleaned through an Anitec desktop plate processor using water as the cleaning liquid.

After cleaning with water, the plates were evaluated for ease of cleaning, diode banding, resolution, and wet rub resistance. Diode banding is a measure of the latitude of the imaging sensitivity due to variations in output among the different IR laser diodes, coating thickness variations, and other variables. A low degree of banding is highly desirable in order to obtain uniform printing images. Resolution is a measure of the finest lines or dots of imaging quality that are achieved on the plate after imaging and post-imaging cleaning. Wet rub resistance is a measure of the finest lines or dots of imaging quality that are maintained on the plate during press operation and is estimated by measuring the finest lines or dots on the plate that survive 50 wet rubs with a WEBRIL cloth, a trademark for a lint-free cloth available from Veratec Corporation, Walpole, Mass., which has been wet with water. The wet rubs each involve a double pass back and forth across the imaged areas so that 50 wet rubs in the wet rub resistance tests of this invention actually involve a total of 100 passes or wet rubs across the imaged area.

In the resolution and wet rub resistance testing of this invention, the image areas are of two types: (1) narrow lines in the form of a series of pixels with the width of the lines based on the number of pixels comprising the width, and (2) half tone dots at 150 lines per inch (lpi) halftone screen imaging. Approximate sizes of these image areas are as follows. One pixel lines are 15 microns wide, and 3 pixel lines are 40 microns wide. 2% Dots are 15 microns in diameter, 3% dots are 20 microns in diameter, 4% dots are 25 microns in diameter, 5% dots are 35 microns in diameter, and 10% dots are 60 microns in diameter. The smaller the widths of the pixel lines and the smaller the diameters of the dot sizes that can be achieved and maintained on the plate are the better for printing quality and press run length with acceptable quality. Thus, achieving a 1 pixel wide line image after cleaning and maintaining the 1 pixel wide line image through the wet rub resistance test is the best result for printing quality. Similarly, achieving a 2% dot image or a dot that is about 15 microns in diameter after cleaning and maintaining the 2% dot image through the wet rub resistance test is the best result for printing quality, and much more desirable compared to maintaining only 5% or 10% dots as the best dot images.

The following summarizes the results:

| Plate | Ease of Cleaning | Best Dots Cleaned | Best Dots Wet Rubbed | Banding |
|---|---|---|---|---|
| "A" | Difficult | 2% | 3% | Severe |
| "B" | Good | 2% | 3% | Moderate |
| "C" | Washes Easily | 2% | 3% | Very Slight |

The weight per cent of p-toluenesulfonic acid component based on the combined weight of polymers present in the ablative-absorbing second layer was 5.4 weight per cent for Plate A; 27.2 weight per cent for plate B; and 49.0 weight per cent for Plate C. It can be seen that a large amount of p-toluenesulfonic acid component from the NACURE 2530 significantly improves the ease of cleaning and decreases the amount of diode banding without any noticeable effect upon resolution.

Example 2

Nitrocellulose-based coatings for the aspect of the present invention with an ablative-absorbing surface layer were prepared to show the effect of increased p-toluenesulfonic acid. Two coatings were prepared as follows:

| Component | Parts (2A) | Parts (2B) |
|---|---|---|
| 2-Butoxyethanol | 93.30 | 84.90 |
| Nitrocellulose (70% 5–6 sec. RS) | 4.58 | 4.17 |
| CYMEL 303 | 0.40 | 0.36 |
| VULCAN VXC 72R | 1.32 | 1.20 |
| NACURE 2530 (25% PTSA) | 0.40 | 9.37 |

Plates were made using the aluminum sheet, hydrophilic third layer, and procedures as described in Example 1 of the present invention except that no ink-accepting first layer was overcoated upon each of the ablative-absorbing layers. Four variations in the cure time of the hydrophilic third layer of from between 30 seconds and 120 seconds at 145° C. were made. Imaging, cleaning, and testing for resolution and wet rub resistance were done as described in Example 1 of this invention. The imager was a Pressteck PEARLSETTER 74 with diodes set to provide about 400 mj/cm$^2$. Results on the imaged plates are summarized as follows:

| Cure Time | Test | Example 2A PIXEL | Example 2A DOTS | Example 2B PIXEL | Example 2B DOTS |
|---|---|---|---|---|---|
| 30 sec. | Cleaned | 1 line | 3% | 1 line | 2% |
| | 50 Rubs Wet | 3 lines | 10% | 1 line | 3% |
| 60 sec. | Cleaned | 1 line | 5% | 1 line | 3% |
| | 50 Rubs Wet | 3 lines | 10% | 1 line | 4% |
| 90 sec. | Cleaned | 1 line | 5% | 1 line | 3% |
| | 50 Rubs Wet | 3 lines | 10% | 1 line | 3% |
| 120 sec. | Cleaned | 1 line | 5% | 1 line | 3% |
| | 50 Rubs Wet | 3 lines | 10% | 1 line | 3% |

The weight per cent of p-toluenesulfonic acid component based on the combined weight of polymers present in the ablative-absorbing layer was 2.8 weight per cent for Example 2A and 71.4 weight per cent for Example 2B. It can be seen that a large amount of p-toluenesulfonic acid component significantly improves the adhesion of nitrocellulose-based coatings for the ablative-absorbing layer with a subsequent improvement in resolution and wet rub resistance.

Example 3

A nitrocellulose-based coating was prepared as described in Example 1 of U.S. Pat. No. 5,493,971 and was coated with a # 8 wire wound rod upon a cured hydrophilic polyvinyl alcohol-based coated, grained, anodized, and silicated aluminum substrate prepared as described in Example 1 of this invention and cured for 120 seconds at 145° C. A second similar cured hydrophilic polyvinyl alcohol-based coated, grained, anodized and silicated substrate was coated with NACURE 2530 (25% PTSA) using a smooth rod and dried only. This primed surface was then coated with the nitrocellulose-based coating from U.S. Pat. No. 5,493,971 (Example 1) using a #8 wire wound rod and cured for 120 seconds at 145° C. Imaging, cleaning, and testing for resolution and wet rub resistance were done as described in Example 1 of this invention. Both plates were imaged on a Presstek PEARLSETTER 74 imager with diodes set to provide about 400 mj/cm$^2$. Results are summarized below:

| | No NACURE Primer | | NACURE Primer Layer | |
|---|---|---|---|---|
| | Pixel | Dots | Pixel | Dots |
| Cleaned | 1 line | 5% | 1 line | 3% |
| 50 Rubs Wet | 3 lines | 10% | 1 line | 3% |

It can be seen that a p-toluenesulfonic acid-based primer layer significantly improves the adhesion of nitrocellulose-based coatings for the ablative-absorbing layer as shown by the improvement in resolution and wet rub resistance.

Example 4

A nitrocellulose-based coating was prepared as described in Example 1 of U.S. Pat No. 5,493,971 and was coated with a #8 wire wound rod upon a cured hydrophilic polyvinyl alcohol-based coated, grained, anodized, and silicated aluminum substrate prepared as described in Example 1 of this invention and cured for 120 seconds at 145° C. A second similar cured hydrophilic polyvinyl alcohol-based coated, grained, anodized and silicated substrate was coated with a 0.875% solids coating of BACOTE 20 using a #3 wire wound rod and dried only. This primed surface was then coated with the nitrocellulose-based coating from U.S. Pat. No. 5,493,971 (Example 1) using a #8 wire wound rod and cured for 120 seconds at 145° C. Imaging, cleaning, and testing for resolution and wet rub resistance were done as described in Example 1 of this invention. Both plates were imaged on a Presstek PEARLSETTER 74 imager with diodes set to provide about 400 mj/cm$^2$.

| | No BACOTE Primer | | BACOTE Primer | |
|---|---|---|---|---|
| Layer | Pixel | Dots | Pixel | Dots |
| Cleaned | 1 line | 5% | 1 line | 1% |
| 50 Rubs Wet | 3 lines | 10% | 1 line | 2% |

It can be seen that a primer layer containing ammonium zirconium carbonate significantly improves the adhesion of nitrocellulose-based coatings with a subsequent improvement in resolution and wet rub resistance.

Example 5

A lithographic printing plate in accordance with the invention was prepared using a grained and anodized aluminum sheet with a silicate over layer. The aluminum sheet was coated with the hydrophilic third layer as described in Example 1 of the present invention and cured for 120 seconds at 145° C. The following ablative-absorbing non-ink accepting second layer was coated on the cured third hydrophilic third layer and cured for 120 seconds at 145° C. BYK 333 is a trademark for a surfactant available from Byk-Chemie USA, Wallingford, Conn.

| Component | Parts |
|---|---|
| AIRVOL 125 (5% solids in water) | 28.61 |
| BACOTE 20 (14% solids in water) | 4.16 |
| Glycerol | 0.07 |
| TRITON X-100 (10% solids in water) | 0.23 |
| BYK 333 (10% solids in water) | 0.33 |
| CAB-O-JET 200 (20% solids in water) | 33.3 |
| NACURE 2530 (25% PTSA) | 23.3 |
| Water | 10.0 |

The ablative-absorbing layer accepted water and did not accept ink when exposed to the ink and water of a wet lithographic printing system.

An ink-accepting first layer from a water-based formulation, as described in Example 1, of this invention was then overcoated upon the ablative-absorbing second layer. It was cured for 120 seconds at 145° C.

Imaging, cleaning, and testing for resolution and wet rub resistance were done as described in Example 1 of this invention. Plates were imaged on Presstek PEARLSETTER 74, and the laser energy at the plate surface was approximately 500 mj/cm$^2$.

The following summarizes the results:

| Ease of Cleaning | Best Dots Cleaned | Best Dots Wet Rubbed | Banding |
|---|---|---|---|
| Washes Easily | 1% | 2% | None |

The weight per cent of p-toluenesulfonic acid component based on the combined weight of polymers present, including the BACOTE 20 crosslinking agent, was 289.4 weight per cent. It can be seen that a large amount of p-toluenesulfonic acid component combined with a specific polyvinyl alcohol-based formulation provides a non-ink accepting ablative absorbing layer that significantly improves the ease of cleaning and resolution and eliminates diode banding. The NACURE 2530 with its p-toluenesulfonic acid component also provided significant dispersion stability and coatability properties to this formulation.

Example 6

Lithographic printing plates in accordance with the invention were prepared using a 5 mil thick polyester film suitable for coating with aqueous coatings. The polyester substrate was coated with the hydrophilic third layer, as described in Example 1 of this invention, and cured for 120 seconds at 145° C. The following ablative-absorbing second layer was coated on the hydrophilic third layer and cured for 120 seconds at 145° C.

| Component | Parts (6A) | Parts (6B) |
|---|---|---|
| AIRVOL 125 (5% solids in water) | 22.0 | 22.0 |
| TRITON X-100 (10% solids in water) | 1.8 | 1.8 |
| 2-Butoxyethanol | 1.9 | 1.9 |
| CYMEL 303 | 0.70 | 0.70 |
| CAB-O-JET 200 (20% solids in water) | 23.5 | 23.5 |
| NACURE 2530 (25% PTSA) | 1.20 | 5.50 |
| Water | 48.9 | 44.6 |

An ink-accepting first layer from a water-based formulation, as described in Example 1 of this invention, was overcoated upon the second layer and then cured for 120 seconds at 145° C.

Imaging, cleaning, and testing for resolution and wet rub resistance were done as described in Example 1 of this invention. The plate was imaged on a Presstek PEARLSETTER 74, and the laser energy at the plate surface was approximately 600 mj/cm$^2$.

The following summarizes the results:

| Plate | Ease of Cleaning | Best Dots Cleaned | Best Dots Wet Rubbed | Banding |
|---|---|---|---|---|
| 6A | Would Not Clean Up | Not Applicable | Not Applicable | Not Applicable |
| 6B | Good | 1% | 2% | None |

The ablative-absorbing second layer of Plate 6A has 16.7 weight per cent of p-toluenesulfonic acid component based on the total weight of polymers in the second layer. For Plate 6B, the weight per cent of p-toluenesulfonic acid component based on the total weight of polymers in the second layer is 76.4 weight per cent. It can be seen that a large amount of p-toluenesulfonic acid component in the ablative-absorbing second layer of a plate of this invention with a flexible hydrophilic polyester film support significantly improves the ease of cleaning, provides good resolution, and eliminates diode banding. In contrast, a lower amount of p-toluenesulfonic acid component did not clean up after laser imaging and thus was not applicable for evaluating banding and resolution after cleaning and wet rub testing.

While the invention has been described in detail and with reference to specific embodiments thereof, it will be apparent to one skilled in the art that various changes and modifications can be made without departing from the spirit and scope thereof.

What is claimed is:

1. A positive working, wet lithographic printing member imageable by laser radiation, said member comprising:

(a) an ink-accepting surface layer comprising one or more polymers and being characterized by the ablative absorption of said laser radiation; and, (b) a hydrophilic substrate;

wherein interposed between said surface layer and said substrate is a primer layer comprising a zirconium compound, said primer layer being characterized by being hydrophilic, by the absence of ablative absorption of said laser radiation, by being not ablated by said ablative absorption of said surface layer, and by being not soluble in water.

2. The member of claim 1, wherein said zirconium compound is ammonium zirconyl carbonate.

3. The member of claim 1, wherein said zirconium compound is zirconium propionate.

4. The member of claim 1, wherein said zirconium compound is zirconium oxide.

5. A positive working, wet lithographic printing member imageable by laser radiation, said member comprising:

(a) an ink-accepting surface layer comprising one or more polymers and being characterized by the ablative absorption of said laser radiation; and, (b) a hydrophilic substrate;

wherein interposed between said surface layer and said substrate is a primer layer, which primer layer is an inorganic gel layer and is characterized by being hydrophilic, by the absence of ablative absorption of said laser radiation, by being not ablated by said ablative absorption of said surface layer, and by being not soluble in water.

6. The member of claim 5, wherein said inorganic gel layer comprises a zirconium oxide gel.

7. A positive working, wet lithographic printing member imageable by laser radiation, said member comprising:

(a) an ink-accepting surface layer comprising one or more polymers and being characterized by the ablative absorption of said laser radiation;

(b) a hydrophilic polymeric layer underlying the surface layer, said hydrophilic polymeric layer being characterized by the absence of ablative absorption of said laser radiation; and, (c) a substrate;

wherein interposed between said surface layer and said hydrophilic polymeric layer is a primer layer comprising an adhesion-promoting agent, said primer layer being characterized by being hydrophilic, by the absence of ablative absorption of said laser radiation, by being not ablated by said ablative absorption of said surface layer, by being not soluble in water, and by debonding from said surface layer upon subjection of said surface layer to imaging radiation.

8. The member of claim 7, wherein said primer layer is further characterized by being not removed by said ablative absorption of said surface layer followed by a cleaning step with water or a cleaning solution to remove any residue of said ablative absorption of said surface layer from the surface of said primer layer.

9. A method of preparing an imaged wet lithographic printing plate, comprising the steps of:

(a) providing a wet lithographic printing member according to claim 7;

(b) exposing said member to a desired imagewise exposure of laser radiation to ablate a part of the surface layer of said member to form a residual composite layer comprising non-ablated materials of said surface layer, said residual composite layer (c) being in contact with but debonded from the primer layer of said member; and cleaning the residual composite layer from said primer layer with water or a cleaning solution, wherein the ink-accepting surface layer of said member is not soluble in water or in said cleaning solution.

10. A positive working, wet lithographic printing member imageable by laser radiation, said member comprising:

(a) an ink-accepting surface layer comprising one or more polymers and being characterized by the ablative absorption of said laser radiation;

(b) a hydrophilic polymeric layer underlying the surface layer, said hydrophilic polymeric layer being characterized by the absence of ablative absorption of said laser radiation; and, (c) a substrate;

wherein interposed between said surface layer and said hydrophilic polymeric layer is a primer layer comprising a zirconium compound, said primer layer being characterized by being hydrophilic, by the absence of ablative absorption of said laser radiation, by being not ablated by said ablative absorption of said surface layer, and by being not soluble in water.

11. The member of claim 10, wherein zirconium compound is ammonium zirconyl carbonate.

12. The member of claim 10, wherein said zirconium compound is zirconium propionate.

13. The member of claim 10, wherein said zirconium compound is zirconium oxide.

14. A positive working, wet lithographic printing member imageable by laser radiation, said member comprising:

(a) an ink-accepting surface layer comprising one or more polymers and being characterized by the ablative absorption of said laser radiation;

(b) a hydrophilic polymeric layer underlying the surface layer, said hydrophilic polymeric layer being characterized by the absence of ablative absorption of said laser radiation; and, (c) a substrate;

wherein interposed between said surface layer and said hydrophilic polymeric layer is a primer layer which primer layer is an inorganic gel layer and is characterized by being hydrophilic, by the absence of ablative absorption of said laser radiation, by being not ablated by said ablative absorption of said surface layer, and by being not soluble in water.

15. The member of claim 14, wherein said inorganic gel layer comprises a zirconium oxide gel.

* * * * *